US009038852B2

(12) United States Patent
Yasaka

(10) Patent No.: US 9,038,852 B2
(45) Date of Patent: May 26, 2015

(54) AUTOMATIC VENDING MACHINE

(75) Inventor: Yoshio Yasaka, Mie (JP)

(73) Assignee: FUJI ELECTRIC CO., LTD., Kawasaki-shi, Kanagawa (JP)

( * ) Notice: Subject to any disclaimer, the term of this patent is extended or adjusted under 35 U.S.C. 154(b) by 42 days.

(21) Appl. No.: 13/982,133

(22) PCT Filed: Sep. 16, 2011

(86) PCT No.: PCT/JP2011/071202

§ 371 (c)(1),
(2), (4) Date: Jul. 26, 2013

(87) PCT Pub. No.: WO2012/124192

PCT Pub. Date: Sep. 20, 2012

(65) Prior Publication Data

US 2013/0299509 A1 Nov. 14, 2013

(30) Foreign Application Priority Data

Mar. 16, 2011 (JP) ..... 2011-057524

(51) Int. Cl.

| | |
|---|---|
| ***G07F 11/60*** | (2006.01) |
| ***G07F 11/24*** | (2006.01) |
| ***G07F 11/64*** | (2006.01) |
| ***G07F 11/40*** | (2006.01) |
| ***G07F 11/00*** | (2006.01) |

(52) U.S. Cl.

CPC ..... *G07F 11/60* (2013.01); *G07F 11/64* (2013.01); *G07F 11/40* (2013.01); *G07F 11/005* (2013.01)

(58) Field of Classification Search

CPC ..... G07F 11/24; G07F 11/34; G07F 11/10; G07F 11/16; G07F 11/62; G07F 11/44; G07F 17/0092; G07F 11/60; B65G 1/08; B65G 1/00; B65G 47/88

USPC ..... 221/1, 9, 295, 301, 183, 92, 2, 5

See application file for complete search history.

(56) References Cited

U.S. PATENT DOCUMENTS 2,772,787 A * 12/1956 Lee ..... 211/75
2,880,904 A 4/1959 Linthicum (Continued)

FOREIGN PATENT DOCUMENTS

EP 0869082 A1 10/1998
EP 2390849 A2 * 11/2011

(Continued)

OTHER PUBLICATIONS

Europe Patent Office, "Search Report for EP 11861024.5," Jul. 31, 2014.

(Continued)

*Primary Examiner* — Rakesh Kumar
(74) *Attorney, Agent, or Firm* — Manabu Kanesaka

(57) ABSTRACT

An automatic vending machine for vending a product selected by a user includes: an automatic vending machine cabinet having an opening that is opened and closed by a door: a plurality of product racks that is provided in the automatic vending machine cabinet, each product rack including a plurality of product storage columns each storing products ordered in a line; and a product storage device that allows a user to take out one product at a time by holding a body of the product, when the door is opened to open the opening.

7 Claims, 33 Drawing Sheets

(56) References Cited

U.S. PATENT DOCUMENTS

| | | | | | |
|---|---|---|---|---|---|
| 4,300,704 | A | * | 11/1981 | Funke et al. | 221/301 |
| 4,310,097 | A | * | 1/1982 | Merl | 211/59.2 |
| 4,401,221 | A | * | 8/1983 | Suttles | 211/59.2 |
| 4,423,816 | A | * | 1/1984 | Suttles | 211/183 |
| 4,705,158 | A | * | 11/1987 | Sirvet | 198/463.4 |
| 5,000,393 | A | * | 3/1991 | Madsen | 242/560 |
| 5,209,358 | A | * | 5/1993 | Simard | 211/74 |
| 5,586,665 | A | * | 12/1996 | Brousseau | 211/59.2 |
| 5,586,687 | A | * | 12/1996 | Spamer et al. | 221/298 |
| 5,695,074 | A | * | 12/1997 | Wiese | 211/59.2 |
| 5,706,956 | A | * | 1/1998 | Headrick et al. | 211/59.2 |
| 5,706,957 | A | * | 1/1998 | Hardy | 211/59.2 |
| 5,718,341 | A | * | 2/1998 | Robertson | 211/59.2 |
| 5,788,091 | A | * | 8/1998 | Robertson et al. | 211/59.2 |
| 6,073,785 | A | * | 6/2000 | Tolfsen | 211/183 |
| 6,523,719 | B2 | * | 2/2003 | Trulaske, Sr. | 221/301 |
| 2002/0066744 | A1 | * | 6/2002 | Trulaske, Sr. | 221/295 |
| 2013/0299509 | A1 | * | 11/2013 | Yasaka | 221/9 |

FOREIGN PATENT DOCUMENTS

| | | | | | |
|---|---|---|---|---|---|
| FR | 2807414 | A1 | * | 10/2001 | B65G 47/28 |
| JP | 07254086 | A | * | 10/1995 | G07F 11/54 |
| JP | H07-254086 | A | | 10/1995 | |
| JP | H07-287786 | A | | 10/1995 | |
| JP | 08182586 | A | * | 7/1996 | A47F 3/026 |
| JP | H08-182586 | A | | 7/1996 | |
| JP | 2000-076535 | A | | 3/2000 | |
| JP | 2000076535 | A | * | 3/2000 | G07F 11/00 |
| JP | 2000-105869 | A | | 4/2000 | |
| JP | 2006-164050 | A | | 6/2006 | |
| WO | WO 0235484 | A1 | * | 5/2002 | |
| WO | WO 0246072 | A1 | * | 6/2002 | |

OTHER PUBLICATIONS

Korea Patent Office, "Notice of Allowance for KR 10-2012-7017505," Mar. 7, 2014.

* cited by examiner (a)

(b)

AUTOMATIC VENDING MACHINE

RELATED APPLICATIONS

The present application is National Phase of International Application No. PCT/JP2011/071202 filed Sep. 16, 2011, and claims priority from Japanese Application No. 2011-057524 filed Mar. 16, 2011.

FIELD

The present invention relates to an automatic vending machine for selling products such as canned-beverages or beverages in plastic bottles.

BACKGROUND

Conventionally known is an automatic vending machine that sells products such as canned-beverages or beverages in plastic bottles and is provided with a product storage column and a bucket. The product storage column stores therein a plurality of products in a manner ordered in a line. The product storage column dispenses one product at a time from the front end of the product storage column when a transport device is driven. In the automatic vending machine, a plurality of the product storage columns are mounted along a horizontal direction on a product rack. In the automatic vending machine, a plurality of the product racks are provided along a vertical direction in a chamber provided to the cabinet of the automatic vending machine.

The bucket receives a product transported from the product storage column. The bucket is provided in a manner enabled to be moved vertically on the front side of the product rack by a bucket driving unit. The bucket driving unit includes an X-axis transport mechanism capable of moving the bucket in the horizontal direction, and a Y-axis transport mechanism capable of moving the bucket including the X-axis transport mechanism in the vertical direction.

In the above-described automatic vending machine, when a user deposits money in a predetermined amount or more and operates a product selection button, the bucket driving unit is driven and moves the bucket to the front side of the product storage column storing therein a product selected to be purchased. Once the product is transported from the product storage column into the bucket, the bucket is moved near a product take-out port. The user is then allowed to take out the product from the product take-out port (see Patent Literature 1, for example).

CITATION LIST

Patent Literature

Patent Literature 1: Japanese Patent Application Laid-open No. 2006-164050

SUMMARY

Technical Problem

To sell a product in the automatic vending machine disclosed in the Patent Literature 1, for example, it is mandatory to drive the bucket driving unit to move the bucket. In addition, the above-described automatic vending machine requires various type of control to move the bucket. Therefore, in such a conventional automatic vending machine, costs have been increased because not only the number of parts has been increased, but also an expensive sensors and the like have been required.

The inventors of the present invention created the present invention by focusing on simplifying structures by assigning a part of the product vending operation to a user, while ensuring the function of selling a product with no one attended, which is the function an automatic vending machine is originally intended for.

In consideration of the background described above, an object of the present invention is to provide an automatic vending machine that can reduce costs.

Solution to Problem

To solve the problem described above and achieve the object, an automatic vending machine for vending a product selected by a user according to the present invention may include: an automatic vending machine cabinet having an opening that is opened and closed by a door; a plurality of product racks that is provided in the automatic vending machine cabinet, each product rack including a plurality of product storage columns each storing products ordered in a line; and a product storage device that includes the product rack, and allows a user to take out one product at a time by holding a body of the product, when the door is opened to open the opening.

Moreover, in the automatic vending machine, the product storage device may include: a rack selecting mechanism that brings the product rack to a configuration in which a product is prevented from being taken out in a standby condition, and that brings the product rack to a configuration in which a product is permitted to be taken out only from a designated one of the product racks when a vending command is given; a releasing mechanism that is provided for each of the product storage columns, that normally prevents a product stored in the product storage column for which the releasing mechanism is provided from being taken out, and that operates correspondingly to an operation of taking out a product and allows only a product closest to the opening to be taken out when the rack selecting mechanism permits the product rack including the product storage column to release a product; and a restricting unit that is provided for each of the product racks, that permits one of the releasing mechanisms to operate and prohibits the other releasing mechanisms in the product rack from operating when the rack selecting mechanism permits the product rack for which the restricting unit is provided to release a product.

Moreover, in the automatic vending machine, the releasing mechanism may include: a first gate member that is provided rotatably in a manner moving forwardly and backwardly with respect to a product storage passage in the product storage column, that is normally positioned inside of the product storage passage to prevent a most downstream product positioned most downstream from being taken out, and permits the most downstream product to be taken out when the first gate member is caused to retreat from the product storage passage; and a second gate member that is provided rotatably in association with the first gate member in a manner moving forwardly and backwardly with respect to the product storage passage, that is caused to retreat from the product storage passage when the first gate member is positioned inside of the product storage passage, and that is brought into the product storage passage to prevent an upstream product positioned adjacent to the most downstream product when the first gate member is caused to retreat from the product storage passage, and the rack selecting mechanism may include: a first sliding member that is normally positioned at a reference position and prevents the first gate member from being caused to retreat from the product storage passage, and that frees the first gate member when the first sliding member is moved from the reference position; a lock member that is normally kept in contact with the second gate member caused to retreat from the product storage passage by being biased by a biasing unit, and is caused to move to a position on top of the second gate member and keeps the second gate member at an orientation positioned inside of the product storage passage when the second gate member is brought into the product storage passage in association with the first gate member being caused to retreat from the product storage passage; a second sliding member that is normally positioned at a reference position and keeps the lock member free, and that separates the lock member from the position on the top of the second gate member by moving the lock member against the biasing force of the biasing unit when the second sliding member is moved from the reference position; and a cam member that moves the first sliding member from the reference position by abutting against the first sliding member when a vending command is given, and that moves the first sliding member and the second sliding member from the respective reference positions by abutting against the first sliding member and the second sliding member when a product removed command is given.

Moreover, in the automatic vending machine, the second gate member is connected to the first gate member with a leaf spring member interposed between the second gate member and the first gate member, and the second gate member is caused to retreat from the product storage passage against the biasing force of the leaf spring member when the first sliding member and the second sliding member are caused to move from the respective reference positions and the second gate member abuts against a product approaching from a downstream side of the product storage passage while the second gate member is positioned inside of the product storage passage.

Moreover, in the automatic vending machine, the product storage column may include a rail member that extends in a front-and-rear direction, and that supports a cap fitting portion to which a cap is fitted removably, the cap fitting portion being provided to a product having a neck portion between the cap fitting portion and a body, so that the rail member supports the product hanging in an upright orientation.

Moreover, in the automatic vending machine, the product storage column may include a setting member that extends in a front-and-rear direction and on which a product having a shape of a cylinder having a top end and a bottom end closed is placed in an upright orientation.

Moreover, in the automatic vending machine, the restricting unit may include a guide member that extends in a direction in which the product storage columns are arranged, has a housing section in which a plurality of piece members are housed slidably in the direction in which the guide member extends, and when a part of the releasing mechanism operating correspondingly to an operation of taking out a product enters the housing section, prevents a part of another releasing mechanism from entering the housing section so that the releasing mechanism is prevented from operating.

Moreover, the automatic vending machine may further include a pusher member that is provided for each of the product storage columns, and presses products stored in the product storage columns forwardly.

Moreover, in the automatic vending machine, at least one of the door and the automatic vending machine cabinet may include a window made from a transparent plate.

Advantageous Effects of Invention

In an automatic vending machine according to the present invention, the product storage device is provided with the product racks, and a user is allowed to take out one product at a time by holding the body of the product when the door is opened and the opening on the automatic vending machine cabinet is opened. In this manner, a user is allowed to purchase a desired product without using a bucket driving unit in a manner practiced in a conventional automatic vending machine. Furthermore, the function of selling a product with no one attended, which is the function an automatic vending machine is originally intended for, can be provided. Furthermore, structures can be simplified by assigning a part of a product selling operation to an operation of a user taking out the product. Therefore, by simplifying the structures and reducing the number of parts, costs can be reduced, advantageously. Furthermore, because the product storage device enables a user to take out one product at a time by holding the body of the product, the user can haptically check the degree by which the product is cooled or heated. Furthermore, when the products are foods packed in a flexible transparent resin, a user can haptically check the softness of the product, and understand how fresh the product is.

DESCRIPTION OF EMBODIMENTS

An automatic vending machine according to a first embodiment of the present invention will be explained in detail with reference to the accompanying drawings.

First Embodiment

Figure 1:
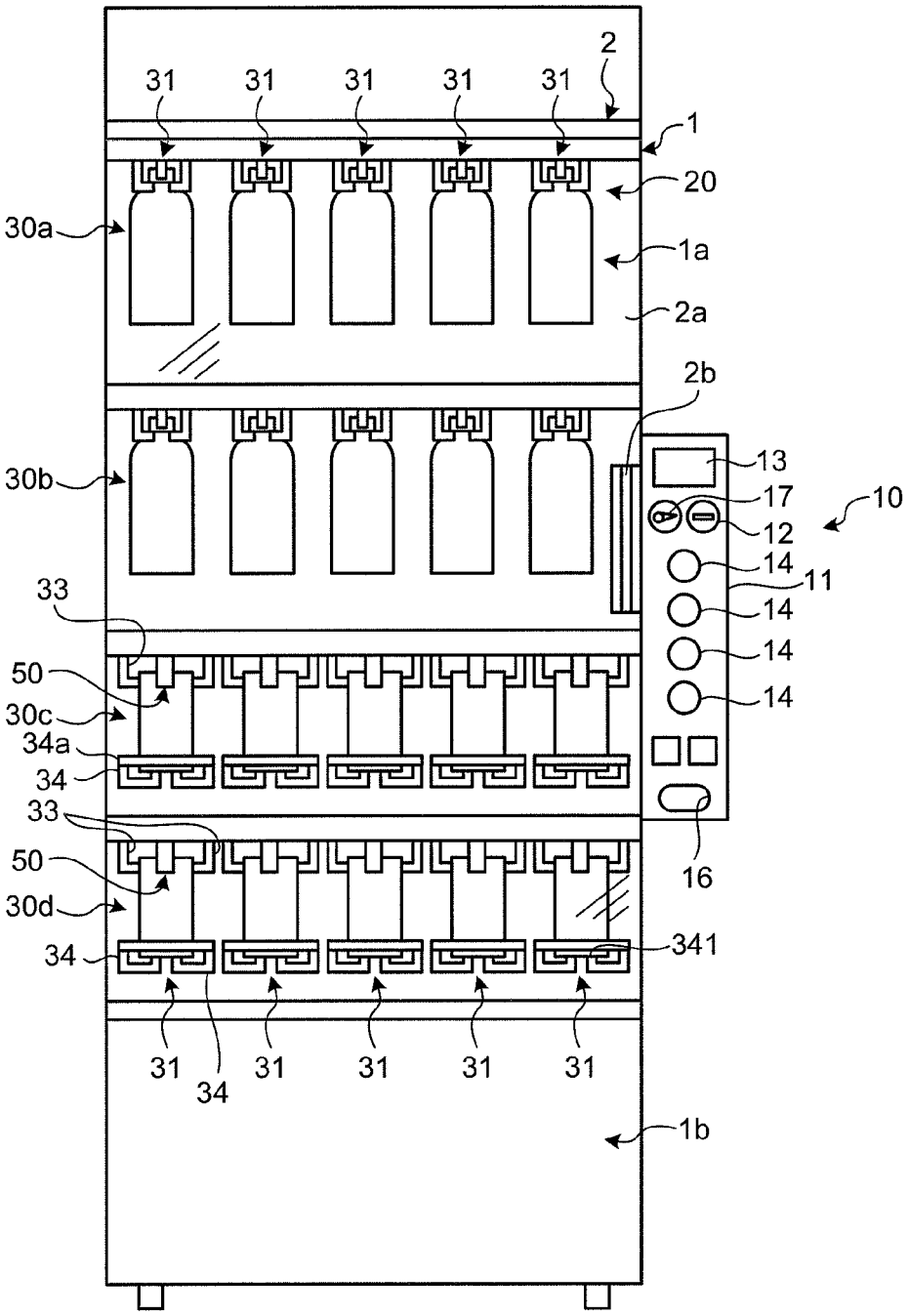
FIG. 1 is a front view illustrating an automatic vending machine according to a first embodiment of the present invention.
Figure 2:
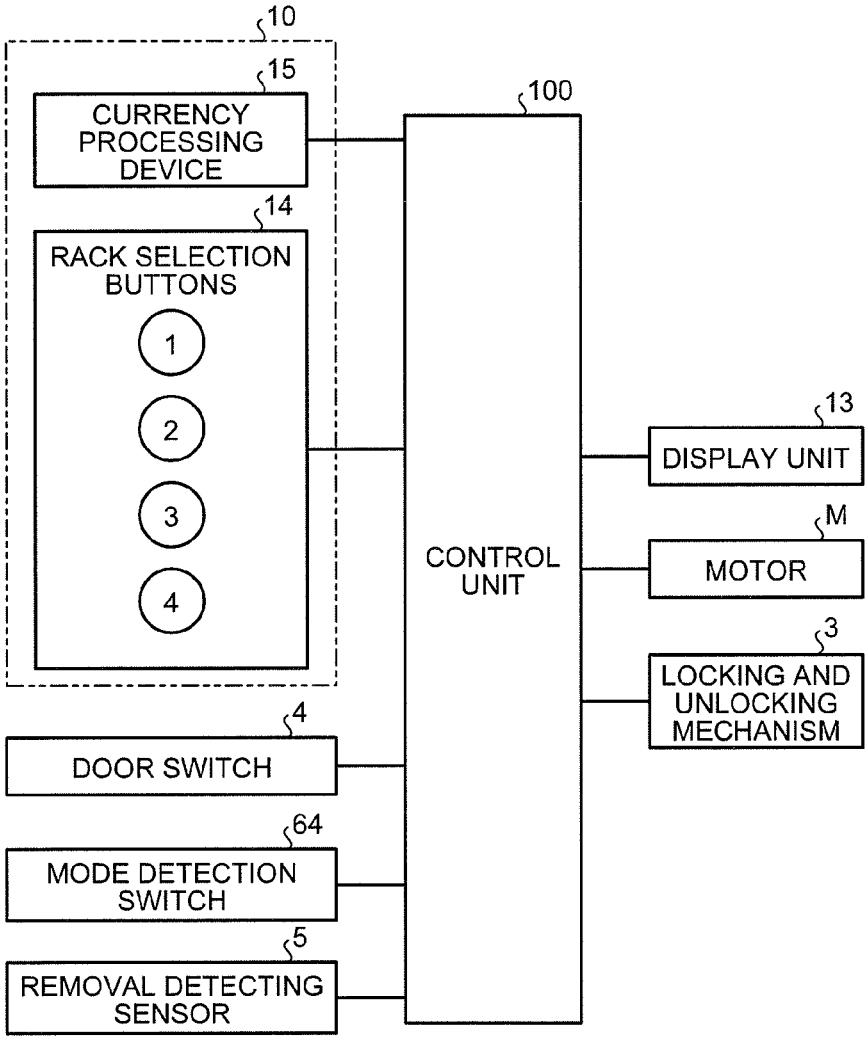
FIG. 2 is a block diagram illustrating a control system provided to the automatic vending machine according to the first embodiment of the present invention.

FIG. 1 is a front view illustrating an automatic vending machine according to the first embodiment of the present invention. FIG. 2 is a block diagram illustrating a control system of the automatic vending machine according to the first embodiment of the present invention. The automatic vending machine described herein as an example is for selling products such as heated or cooled canned-beverages or beverages in plastic bottles, and includes a vendor cabinet 1.

The vendor cabinet 1 is a housing having a cuboid shape, and the front side of which has an opening provided with an external door (door body) 2 that is opened and closed. The external door 2 is provided with a thermal insulation material as appropriate, and has a window 2*a* fitted with a transparent plate such as a heat-resistant glass. Through the window 2*a* on the external door 2, inside of the automatic vending machine can be seen. A handle 2*b* is provided on the right-hand side of the center of the front side of the external door 2.

A locking and unlocking mechanism 3 restricts opening and closing of the external door 2, and a door switch 4 detects if the external door 2 is opened or closed. When the locking and unlocking mechanism 3 is locked, the external door 2 is prevented from being opened, so that the opening on the front side of the vendor cabinet 1 is kept closed. When the locking and unlocking mechanism 3 is unlocked, the external door 2 is permitted to be opened and to be closed. The door switch 4 turns ON when the opening on the front side of the vendor cabinet 1 is closed by the external door 2. The door switch 4 turns OFF when the external door 2 is opened and the opening on the front side of the vendor cabinet 1 is opened.

The inner space of the vendor cabinet 1 is partitioned into two compartments, upper one of which is a chamber 1*a*, and lower one of which is a machinery chamber 1*b*. The chamber 1*a* is a chamber inside of which is kept to a preset temperature, and each wall member making up the chamber 1*a* is a thermal insulation material. The chamber 1*a* is provided with means for cooling the air inside of the chamber, such as an evaporator (not illustrated), and means for heating the air inside of the chamber, such as an electric heater (not illustrated). The machinery chamber 1*b* is provided with a refrigerator (not illustrated) making up a refrigerating cycle together with the evaporator, various controlling equipment (not illustrated), and the like.

An input processing unit 10 is provided on the right-hand side of the vendor cabinet 1 having the structure described above. The input processing unit 10 includes a box-like main unit 11. The main unit 11 has a robust structure. On the front side of the main unit 11, a coin deposit slot 12, a display unit 13, rack selection buttons 14, and the like are provided. A currency processing device 15 is provided inside of the main unit 11.

The coin deposit slot 12 is an opening for depositing coins. The display unit 13 provides various displays in response to a display command from a control unit 100. The display unit 13 displays, for example, the amount of currency deposited (deposited amount), or "now available" when the automatic vending machine is ready to vend products.

The rack selection buttons 14 are a plurality (four in the example illustrated) of pressing buttons arranged vertically. Each of the rack selection buttons 14 is associated with corresponding one of product racks 30*a* to 30*d* included in a product storage device 20, which is to be described later, and provides an input signal to the control unit 100 when a user performs a pressing operation.

The currency processing device 15 performs currency processing for identifying if the coin deposited through the coin deposit slot 12 is genuine or counterfeit, identifying the type of the coin, and sorting the coins by type. The currency processing device 15 provides information of the amount deposited into the coin deposit slot 12 to the control unit 100, and returns a change. The change is returned through a coin return 16. The currency processing device 15 also returns the deposited coins through the coin return 16 when the user operates a return lever 17 after depositing coins into the coin deposit slot 12. The currency processing device 15 also returns a coin through the coin return 16 when the currency processing device 15 is incapable of identifying the coin.

Figure 3:
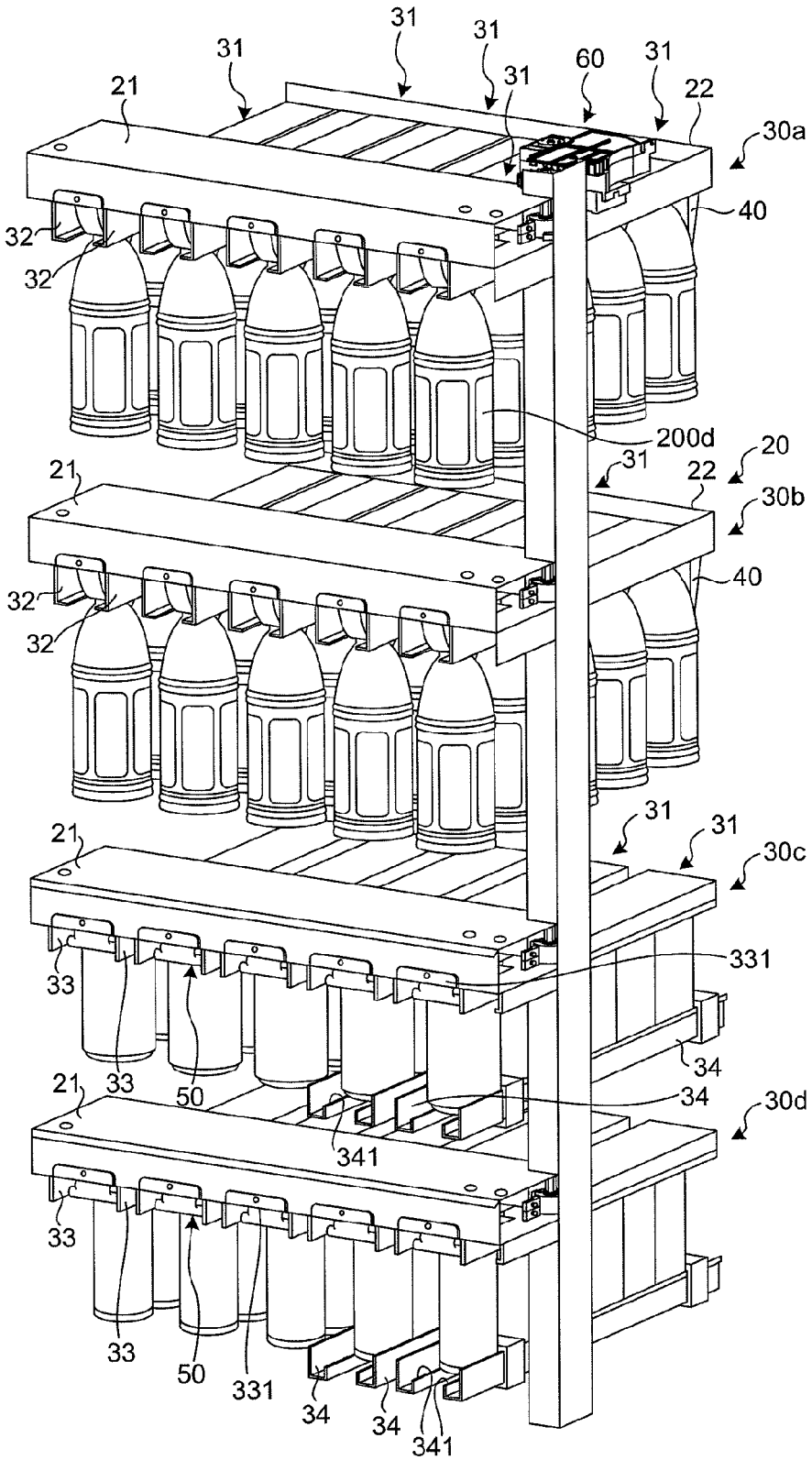
FIG. 3 is a perspective view illustrating a product storage device illustrated in FIG. 1, with some structural elements removed.

The product storage device 20 is provided to the chamber 1*a* in the vendor cabinet 1. FIG. 3 is a perspective view illustrating the product storage device 20 in the automatic vending machine illustrated in FIG. 1, with some structural elements removed.

As illustrated in FIG. 3, the product storage device 20 includes the product racks 30*a* to 30*d*, a rack selecting mechanism 60, a releasing mechanism 50, and a restricting unit 70.

A plurality (four in the example illustrated) of the product racks 30*a* to 30*d* are provided. The product racks 30*a* to 30*d* are provided multiple levels along a vertical direction, in a manner extending between a pair of right and left rack supporting side boards not illustrated. In the first embodiment, the top product rack 30*a* and the second product rack 30*b* from the top store therein beverage products in plastic bottles and have the same structure, and the third product rack 30*c* from the top and the bottommost product rack 30*d* store therein canned-beverage products and have the same structure.

Each of the product racks storing therein beverage products in plastic bottles (the top product rack 30*a* and the second product rack 30*b* from the top) includes a plurality (five in the example illustrated) of product storage columns 31 that are arranged side by side in the horizontal direction. Each of the product storage columns 31 includes a pair of right and left rail members 32. The pair of right and left rail members 32 extend in a front-and-rear direction, and a product storage passage is defined between these rail members.

Figure 4:
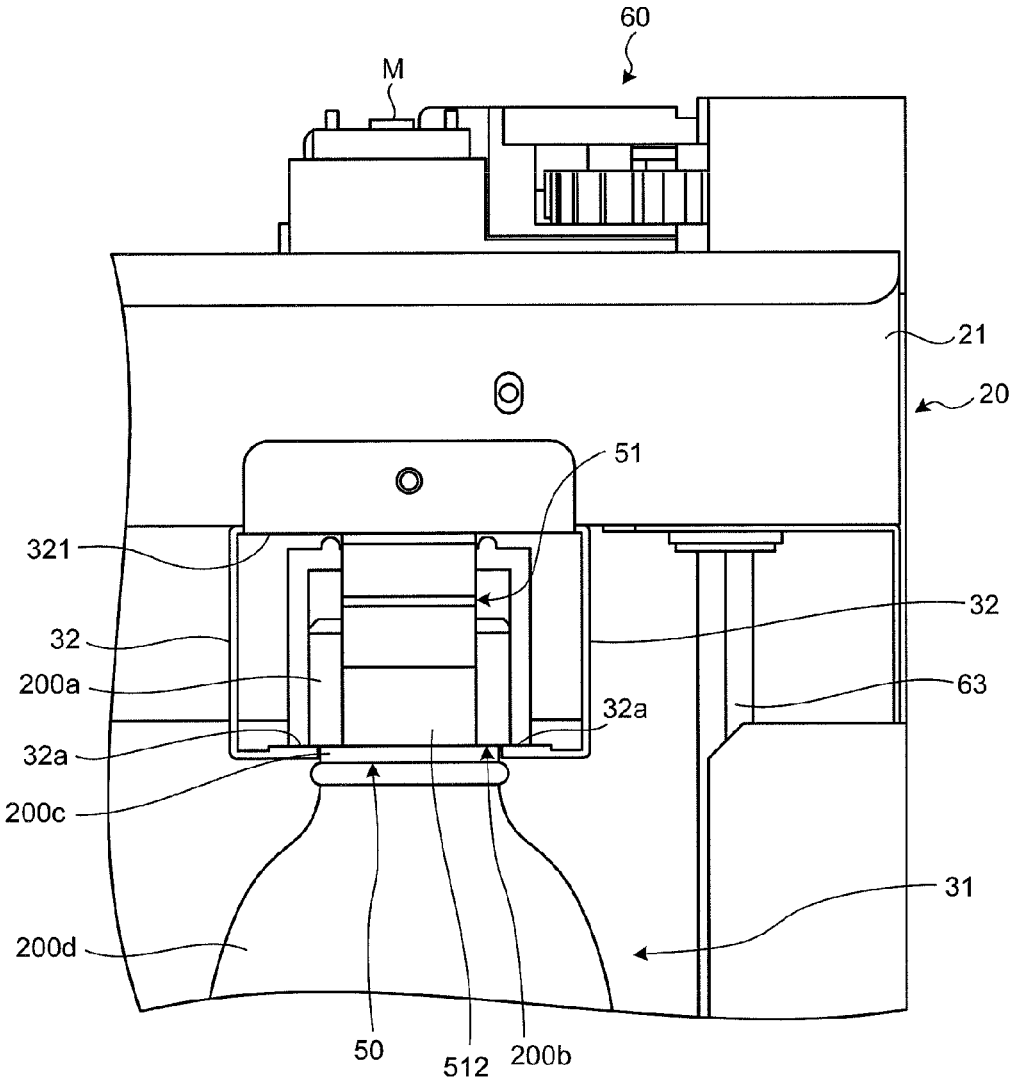
FIG. 4 is an enlarged front view of the rightmost product storage column in the top product rack viewed from the front side.

FIG. 4 is an enlarged front view illustrating the rightmost product storage column 31 in the top product rack 30*a* viewed from the front side. Although illustrated in FIG. 4 is the rightmost product storage column 31 in the top product rack 30*a*, the other product storage columns 31 provided to the top product rack 30*a* and to the second product rack 30*b* from the top have the same structure.

The product stored in the top product rack 30*a* and the second product rack 30*b* from the top is a beverage enclosed in a container (plastic bottle) having a neck portion 200*c* extending between a cap fitting portion 200*b* to which a cap 200*a* is removably fitted and a body 200*d*.

The top end of each of the rail members 32 is connected to a base portion 321 extending along the front-and-rear direction. The base portion 321 is provided in a manner supported by a front horizontal member 21 and a rear horizontal member 22 both extending along the horizontal direction. The front horizontal member 21 and the rear horizontal member 22 extend between the rack supporting side boards.

Each of the rail members 32 is formed by bending a steel plate as appropriate. One of the pair of the rail members 32 has an L-shape when viewed from the front side, and the other has a reversed L-shape when viewed from the front side, and the right and left rail members 32 are provided as a pair. The width of the product storage passage, which is the interval between the pair of the right and the left rail members 32, is larger than the maximum width of the neck portion 200*c* of a product to be stored (a beverage in a plastic bottle), and smaller than the maximum width of the cap fitting portion 200*b* of the product.

Therefore, when a product is placed in an upright orientation in a manner having the neck portion 200*c* inserted in the product storage passage, a part of the cap fitting portion 200*b* is placed on edge portions 32*a* of the pair of the right and the left rail members 32. In this manner, the rail members 32 support the product in a manner hanging by supporting the cap fitting portion 200*b* of the product, and stores the products in a manner lined in the front-and-rear direction in the product storage passage.

Each of the product racks storing therein canned-beverage products (the third product rack 30*c* from the top and the bottommost product rack 30*d*) includes a plurality (five in the example illustrated) of product storage columns 31 arranged side by side in the horizontal direction, in the same manner as the product racks 30*a* and 30*b* storing therein beverage products in plastic bottles. The product stored in the product racks 30*c* and 30*d* has a shape of a cylinder having the top end and the bottom end closed, and in which a beverage is enclosed.

Each of the product storage columns 31 includes a pair of right and left guide members 33 and a pair of right and left setting members 34. The guide members 33 are provided as a pair of a right guide member and a left guide member extending in the front-and-rear direction, and a product storage passage is defined between these members. The top end of each of the guide members 33 is connected to a base portion 331 extending in the front-and-rear direction. The base portion 331 is provided in a manner supported by the front horizontal member 21 and the rear horizontal member 22 extending in the horizontal direction. The setting members 34 are provided under the guide members 33 as a pair of a right setting member and a left setting member extending in the front-and-rear direction. A product is placed on an end 341 of each standing part facing each other included in each of the setting members 34. The setting members 34 are also supported by the rack supporting side boards via supporting members (not illustrated). A restricting member 34*a* is provided on the front end of each of the pair of the right and the left setting members 34 in a manner connecting these setting members 34 (see FIG. 1).

In the above-described product storage column 31, when products are inserted from a front side into the product storage passage in an upright orientation, the products are stored in the product storage passage in a manner sitting on the setting members 34 and in a manner lined in the front-and-rear direction.

Figure 5:
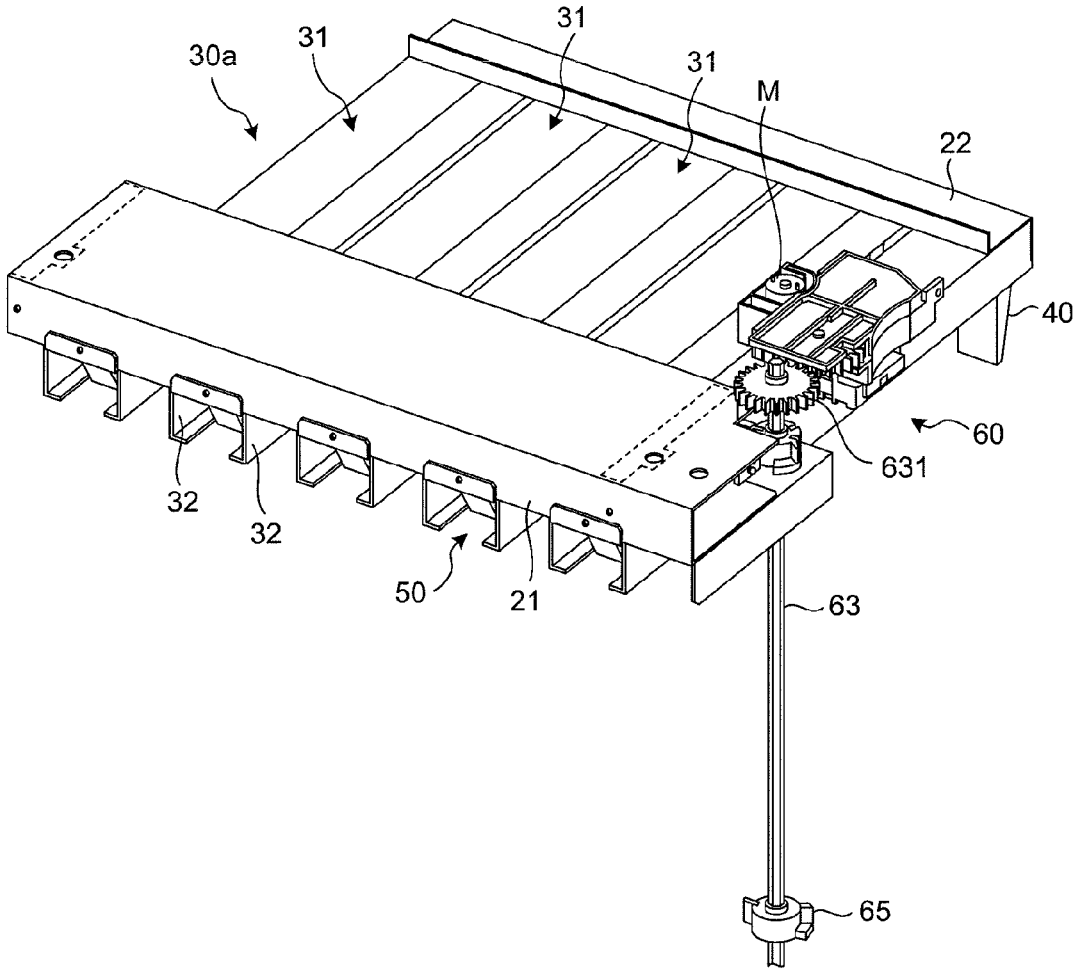
FIG. 5 is a perspective view illustrating peripheral structures around the top product rack illustrated in FIG. 3.
Figure 6:
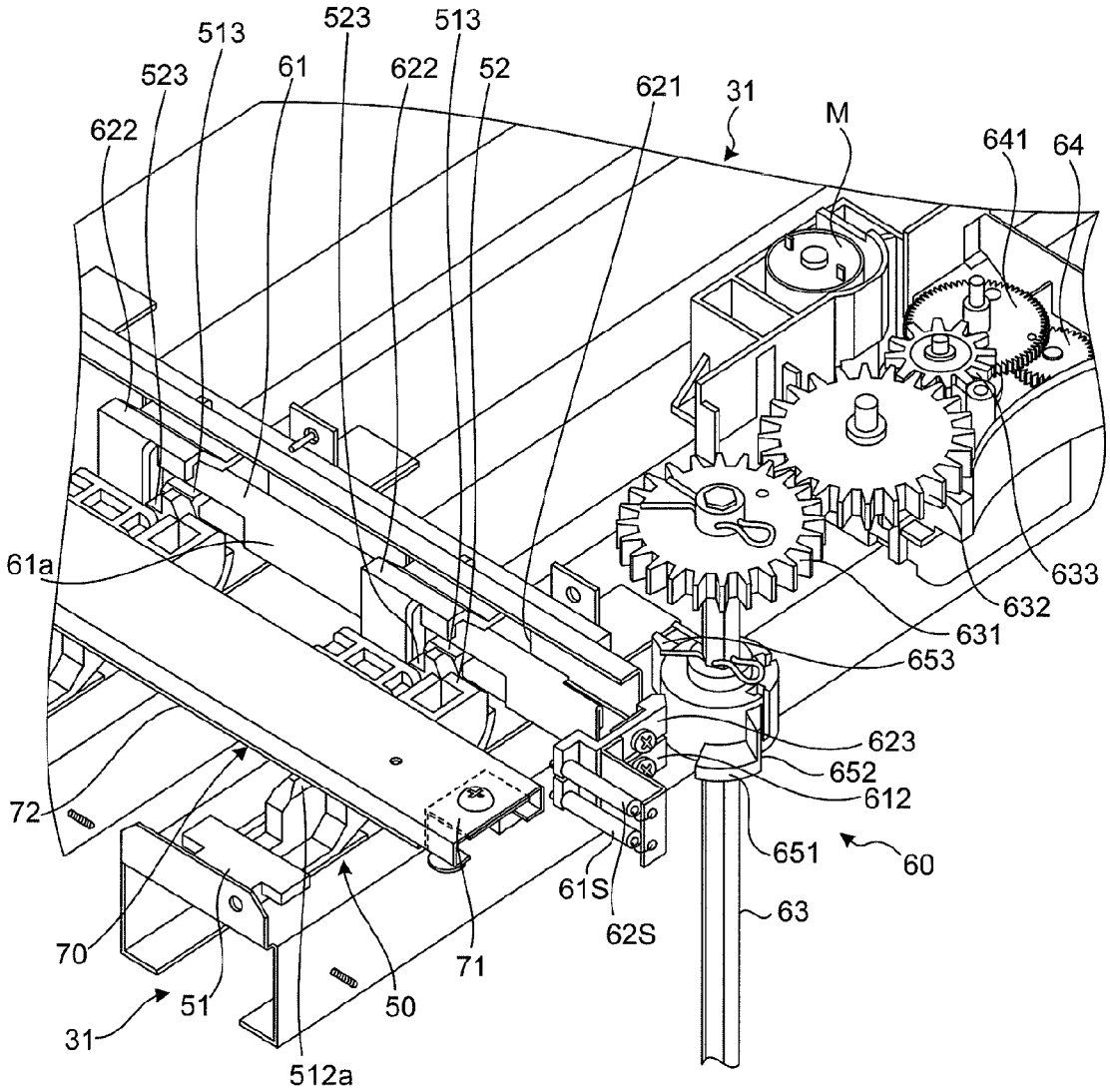
FIG. 6 is an enlarged perspective view of the relevant portion of the peripheral structures illustrated in FIG. 5, with some structural elements removed.
Figure 7:
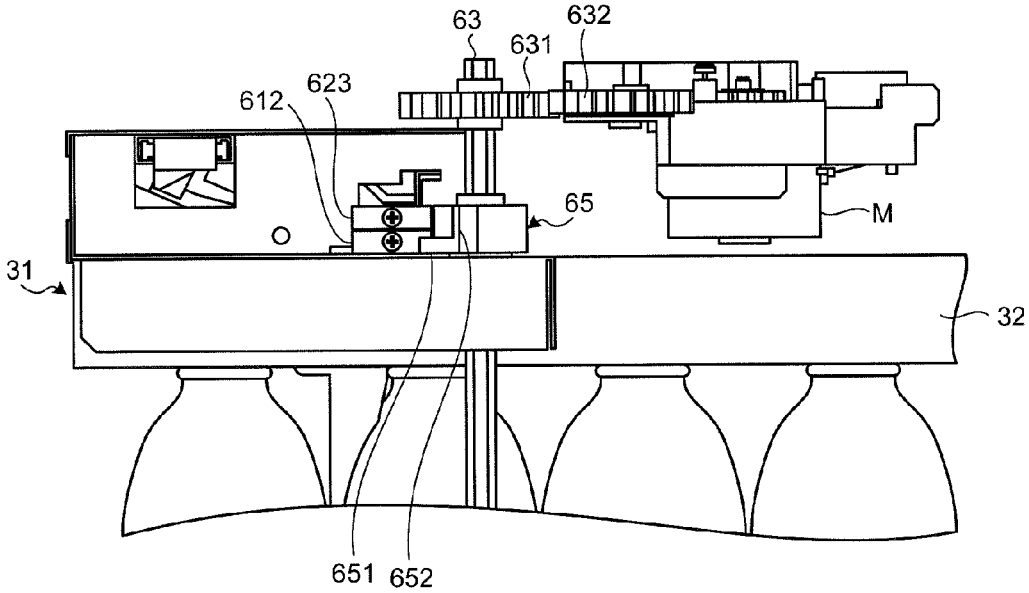
FIG. 7 is a side view illustrating the relevant portion of the peripheral structures illustrated in FIG. 5 viewed from the right side.
Figure 8:
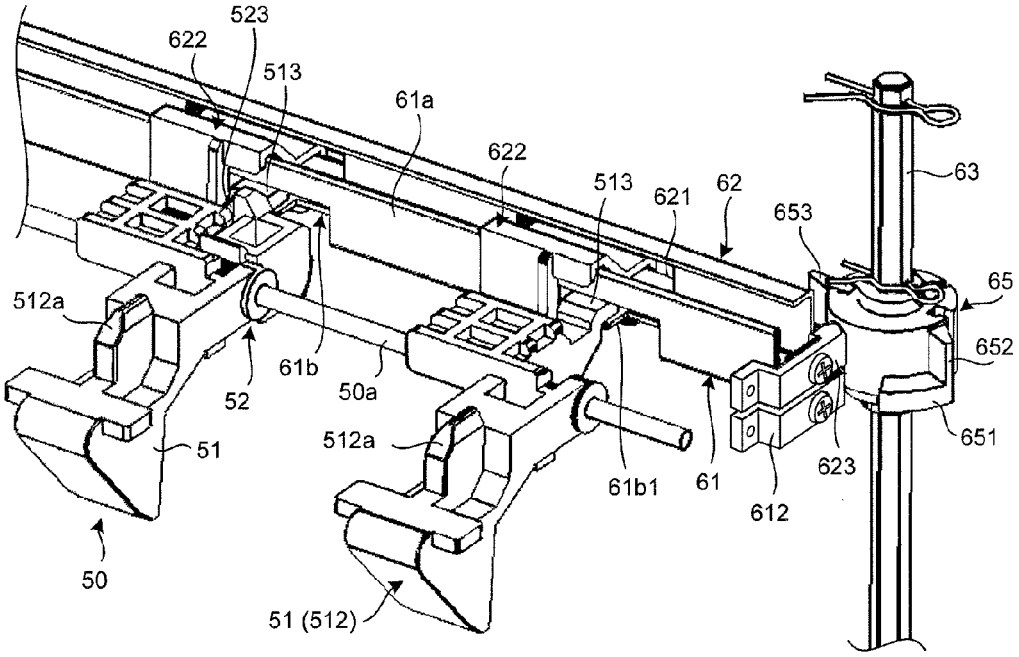
FIG. 8 is a perspective view of an extraction of a part of the relevant portion of the peripheral structures illustrated in FIG. 6.
Figure 9:
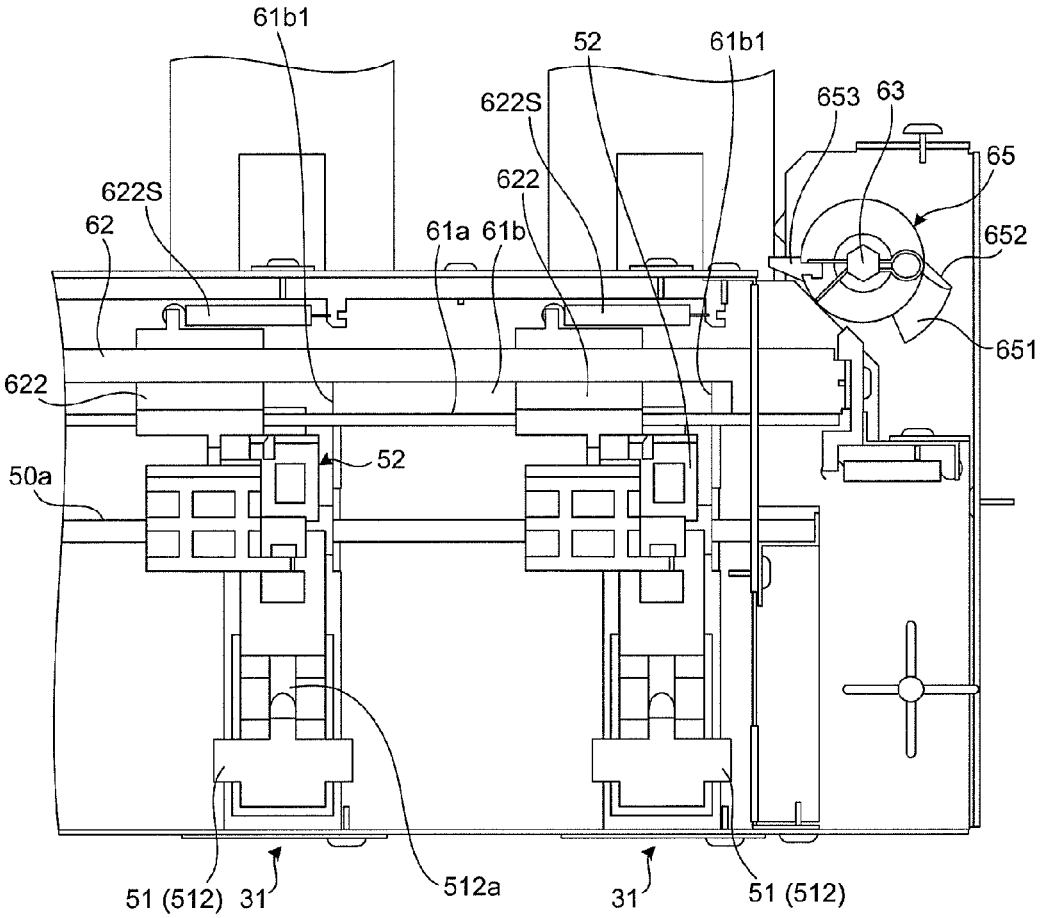
FIG. 9 is a plan view illustrating the relevant portion of the peripheral structures illustrated in FIG. 5 viewed from top, with some structural elements removed.

FIG. 5 is a perspective view illustrating peripheral structures around the top product rack 30*a* illustrated in FIG. 3. FIG. 6 is an enlarged perspective view of a relevant portion of the peripheral structures illustrated in FIG. 5, with some structural elements removed. FIG. 7 is a side view illustrating the relevant portion of the peripheral structures illustrated in FIG. 5 viewed from the right side. FIG. 8 is a perspective view of an extraction of a part of the relevant portion of the peripheral structures illustrated in FIG. 6. FIG. 9 is a plan view illustrating the relevant portion of the peripheral structures illustrated in FIG. 5 viewed from top, with some structural elements removed. The rack selecting mechanism 60 will be explained using these drawings as necessary.

The rack selecting mechanism 60 includes a first sliding plate 61, a second sliding plate 62, a support rod 63, and a mode detection switch 64.

The first sliding plate 61 is provided on the upper front side of the product storage columns 31 in each of the product racks 30*a* to 30*d*, in a manner extending in the horizontal direction. The first sliding plate 61 includes a slide base portion 61*a* extending in the vertical direction, and a slide bottom portion 61*b* bent and extending backwardly from the bottom end of the slide base portion 61*a*.

The slide bottom portion 61*b* is provided with a plurality of cutouts 61*b*1 each connected to a cutout formed on the slide base portion 61*a*. The number of the cutout 61*b*1 provided to the slide bottom portion 61*b* is five which is the same as the number of the product storage columns 31 provided to the product rack. The first sliding plate 61 is always biased to right by a first spring member 61S, and is normally positioned at a reference position.

The second sliding plate 62 is provided in a manner extending in the horizontal direction on the upper front side of the product storage columns 31 in each of the product racks 30*a* to 30*d*. The second sliding plate 62 is provided behind the first sliding plate 61 in parallel with the first sliding plate 61. The second sliding plate 62 is always biased to the right by a second spring member 62S, and is normally positioned at a reference position.

The second sliding plate 62 is provided with a plurality of through-holes 621. A lock member 622 is provided in a manner passing through the through-holes 621. The rear end of the lock member 622 is connected to a lock spring member 622S, and the lock member 622 is biased to the right by the lock spring member 622S. The lock member 622 is provided in a manner straddling over the first sliding plate 61, and the front end of the lock member 622 is positioned on the front side of the first sliding plate 61.

The support rod 63 is a rod-like body having a shape of a hexagonal cylinder, for example, extending in a vertical direction in the frontal right area of the product racks 30*a* to 30*d*. A coupling gear 631 is provided to the top end of the support rod 63. The coupling gear 631 is engaged with an output gear 633 of a motor M via a coupled gear 632. The motor M is a driving source that is driven when a driving command is received from the control unit 100 (see FIG. 2), and causes the output gear 633 to rotate in a clockwise direction, viewing the output gear 633 from the top. The coupling gear 631 engaged with the output gear 633 via the coupled gear 632 is also caused to be rotated in the clockwise direction when viewed from the top, and the support rod 63 is also caused to rotate about the central axis of the support rod 63 in the clockwise direction.

A plurality (for example, four) of switching cam members 65 are mounted on the support rod 63. The switching cam members 65 are mounted on the support rod 63 so that the support rod 63 is passed through a through-hole on each of the switching cam members 65, and each of the switching cam members 65 corresponds to the height level of each of the product racks 30*a* to 30*d*. The switching cam members 65 rotate integrally with the support rod 63. The switching cam members 65 can be displaced along a direction in which the support rod 63 extends (vertical direction) in a configuration in which the support rod 63 is passed through the switching cam members 65, and can be displaced correspondingly to the height level of each of the product racks 30*a* to 30*d*. In other words, each of the switching cam members 65 can be displaced correspondingly to the height level of each of the product racks 30*a* to 30*d*.

Figure 10:
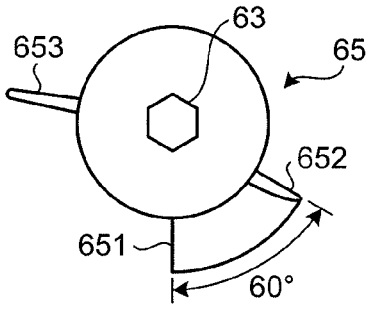
FIG. 10 is a plan view illustrating a topmost switching cam member.

As illustrated in FIG. 10, the switching cam member 65 is provided with a first protrusion 651, a second protrusion 652, and a third protrusion 653. The first protrusion 651 is provided on a lower part of the outer circumference of the switching cam member 65, in a manner protruding outwardly in a radial direction. The first protrusion 651 is provided by 60 degrees, as an example, in the clockwise direction with reference to the central axis of the switching cam member 65 (the central axis of the support rod 63), for example.

The second protrusion 652 is provided to extend upwardly from an end of the first protrusion 651. The third protrusion 653 is provided at a position interspaced from the second protrusion 652 by a predetermined angle in the counterclockwise direction with reference to the central axis (the central axis of the support rod 63), and extends in the vertical direction.

Each of the switching cam members 65 mounted on the support rod 63 is provided in a manner so that the first protrusion 651 and the second protrusion 652 on one of the switching cam members 65 are interspaced from those on the other switching cam members 65 by a predetermined angle about the central axis of the support rod 63, and so that the third protrusions 653 on all of the switching cam members are aligned in the vertical direction.

An example of how the first protrusion 651, the second protrusion 652, and the third protrusion 653 are provided on each of the switching cam members 65 will now be explained. It should be needless to say that explained herein is merely an example, and the present invention is not limited thereto.

Figure 11:
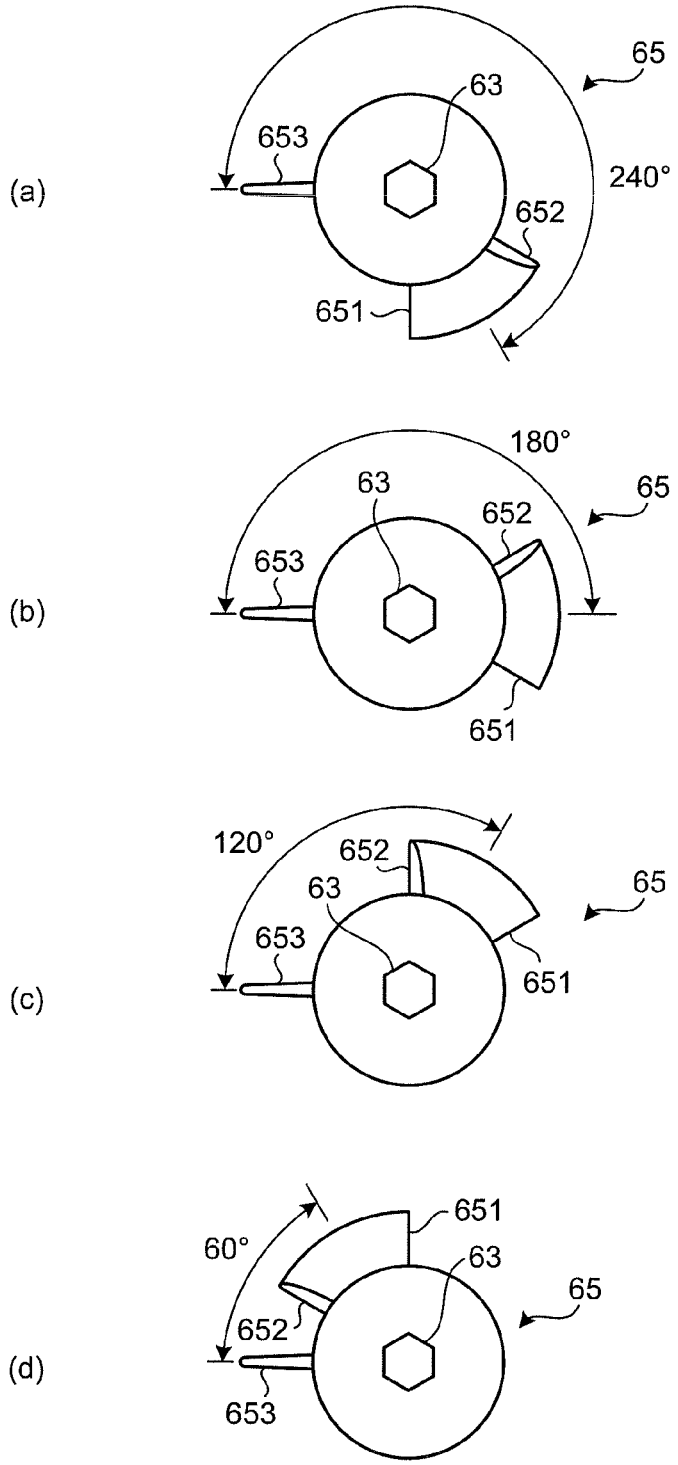
FIG. 11 is a plan view illustrating each switching cam member.

FIG. 11 is a schematic for explaining each of the switching cam members 65 viewed from top. (a) in FIG. 11 illustrates the topmost switching cam member 65. (b) in FIG. 11 illustrates the second switching cam member 65 from the top. (c) in FIG. 11 illustrates the third switching cam member 65 from the top. (d) in FIG. 11 illustrates the bottommost switching cam member 65.

In the second switching cam member 65 from the top, the first protrusion 651 and the second protrusion 652 are provided at positions offset from those on the topmost switching cam member 65 by 60 degrees in the counterclockwise direction with reference to the central axis of the support rod 63.

In the third switching cam member 65 from the top, the first protrusion 651 and the second protrusion 652 are provided at positions offset those on the second switching cam member 65 from the top by 60 degrees in the counterclockwise direction with reference to the central axis of the support rod 63.

In the bottommost switching cam member 65, the first protrusion 651 and the second protrusion 652 are provided at positions offset from those on the third switching cam member 65 from the top by 60 degrees in the counterclockwise direction with reference to the central axis of the support rod 63.

The third protrusion 653 on the topmost switching cam member 65 is provided at a position offset from the center of the first protrusion 651 on the same switching cam member 65 by 240 degrees in the counterclockwise direction with reference to the central axis of the support rod 63. The third protrusion 653 on the second switching cam member 65 from the top is provided at a position offset from the center of the first protrusion 651 on the same switching cam member 65 by 180 degrees in the counterclockwise direction with reference to the central axis of the support rod 63. The third protrusion 653 on the third switching cam member 65 from the top is provided at a position offset from the center of the first protrusion 651 on the same switching cam member 65 by 120 degrees in the counterclockwise direction with reference to the central axis of the support rod 63. The third protrusion 653 on the bottommost switching cam member 65 is provided at a position offset from the center of the first protrusion 651 on the same switching cam member 65 by 60 degrees in the counterclockwise direction with reference to the central axis of the support rod 63.

The mode detection switch 64 detects rotational angular positions of the switching cam members 65 by detecting a mode of a mode gear 641 that engages with the output gear 633 on the motor M. When the rotational angular positions are detected, the mode detection switch 64 provides a detection signal indicating that the angular positions are detected to the control unit 100. An example of rotational angular positions detected by the mode detection switch 64 will now be described. It should be needless to say that explained herein is merely an example, and the present invention is not limited thereto.

The mode detection switch 64 detects six rotational angular positions including a "standby position", a "60-degree-rotated position", a "120-degree-rotated position", a "180-degree-rotated position", a "240-degree-rotated position", and a "300-degree-rotated position".

The "standby position" is a reference position, and is a position at which none of the switching cam members 65 abuts against the first sliding plate 61 and the second sliding plate 62.

The "60-degree-rotated position" is a position at which the support rod 63 is rotated from the "standby position" by 60 degrees in the clockwise direction. In this position, the first protrusion 651 on the topmost switching cam member 65 abuts against the first sliding plate 61 in the top product rack 30*a*, and causes the first sliding plate 61 to move to the left.

The "120-degree-rotated position" is a position at which the support rod 63 is rotated by 120 degrees in the clockwise direction. At this position, the first protrusion 651 on the second switching cam member 65 from the top abuts against the first sliding plate 61 in the second product rack 30*b* from the top, and causes the first sliding plate 61 to move to the left.

The "180-degree-rotated position" is a position at which the support rod 63 is rotated by 180 degrees in the clockwise direction. At this position, the first protrusion 651 on the third switching cam member 65 from the top abuts against the first sliding plate 61 in the third product rack 30*c* from the top, and causes the first sliding plate 61 to move to the left.

The "240-degree-rotated position" is a position at which the support rod 63 is rotated by 240 degrees in the clockwise direction. At this position, the first protrusion 651 on the bottommost switching cam member 65 abuts against the first sliding plate 61 in the bottommost product rack 30*d*, and causes the first sliding plate 61 to move to the left.

The "300-degree-rotated position" is a position at which the support rod 63 is rotated by 300 degrees in the clockwise direction. At this position, the third protrusions 653 on all of the switching cam members 65 abut against the respective first sliding plates 61 and second sliding plate 62 in the product racks 30*a* to 30*d*, and cause the respective first sliding plates 61 and second sliding plate 62 to move to the left.

Figure 12:
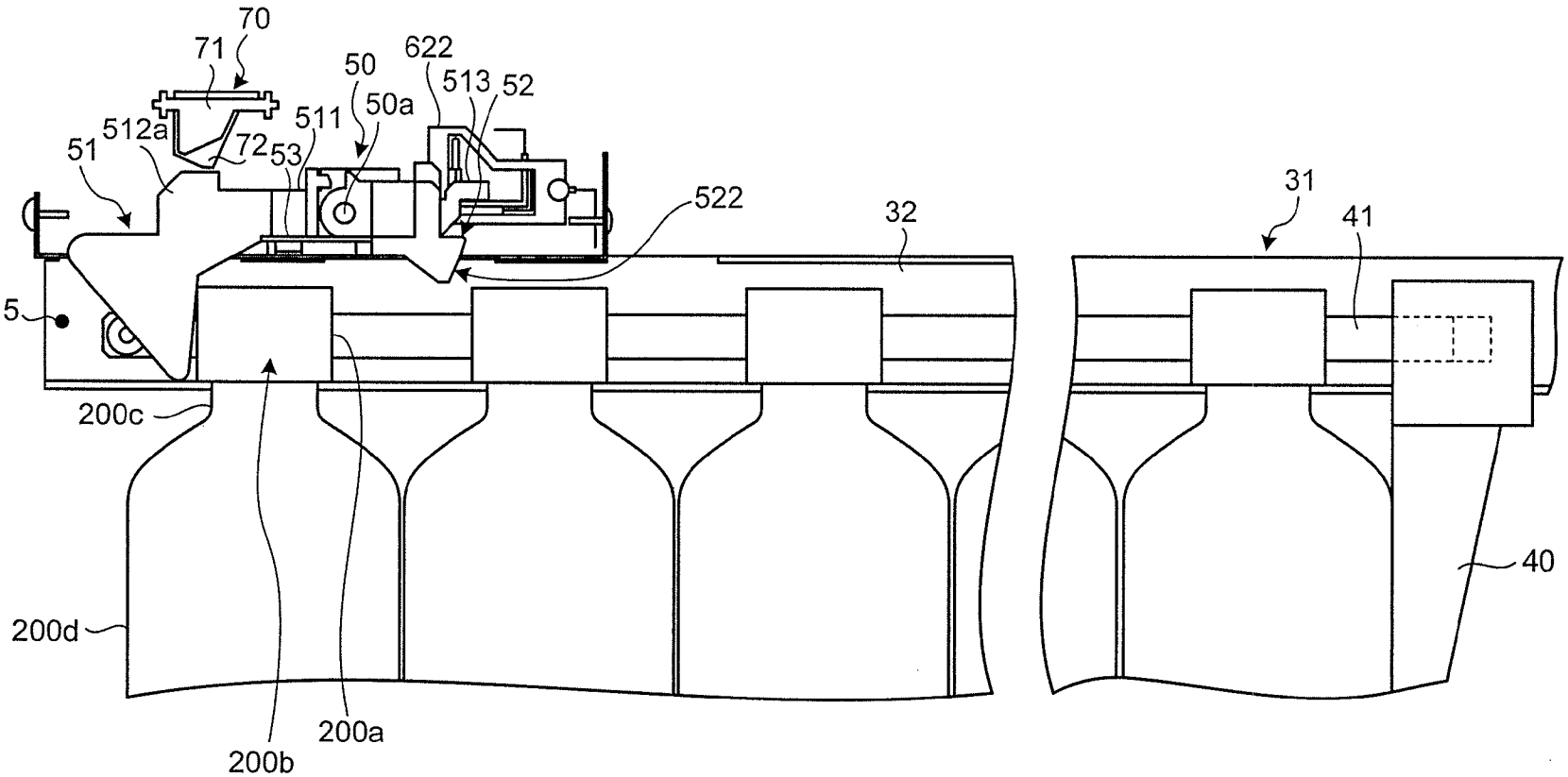
FIG. 12 is a schematic depiction of a product storage column provided to a product rack illustrated in FIGS. 6 and 7, and is a schematic for explaining a view from the right side.

FIG. 12 is a schematic depiction of the product storage column 31 provided to the product rack 30*a* illustrated in FIGS. 6 and 7, and is a schematic for explaining a view from the right side. As illustrated in FIG. 12, the releasing mechanism 50 is provided for each of the product storage columns 31. In the example, the releasing mechanism 50 is illustrated to be provided to the product storage columns 31 in the top product rack 30*a*, but the releasing mechanism 50 is provided for each of the product storage columns 31 in each of the product racks 30*a* to 30*d*.

The releasing mechanism 50 includes a first gate member 51 and a second gate member 52. The first gate member 51 has a base end 511 supported about a shaft 50*a* that extends in the horizontal direction, and a tip end 512 extending further to the front side than the base end 511. The first gate member 51 is capable of rotating about the central axis of the shaft 50*a*, using the central axis as the center. A gate spring member (not illustrated) is interposed between the first gate member 51 and the shaft 50*a*. The gate spring member biases the first gate member 51 so that the first gate member 51 is kept at a position rotated downwardly, and the tip end 512 is kept inside of the product storage passage. When the tip end 512 of the first gate member 51 is positioned inside of the product storage passage, the tip end 512 is positioned in front of the foremost product. When the first gate member 51 is rotated upwardly against the biasing force of the gate spring member, the tip end 512 is caused to retreat from the product storage passage.

The first gate member 51 also includes a first engaging portion 513 protruding backwardly. When the tip end 512 of the first gate member 51 is positioned inside of the product storage passage and the first sliding plate 61 is positioned at the reference position, the first engaging portion 513 is positioned on top of the left edge of the cutout 61*b*1 (see FIG. 8). Therefore, even when a force rotating the first gate member 51 upwardly is applied to the first gate member 51, the upward rotation is restricted because the first engaging portion 513 abuts against the left edge of the cutout 61*b*1.

The second gate member 52 is provided on the rear side of the first gate member 51, and is capable of rotating about the central axis of the shaft 50*a*. The second gate member 52 is connected to the first gate member 51 via a leaf spring member 53.

When the tip end 512 of the first gate member 51 is positioned inside of the product storage passage, a tip end 522 of the second gate member 52 is at a position retreating from the product storage passage. By contrast, when the tip end 512 of the first gate member 51 is caused to retreat from the product storage passage, the tip end 522 comes to be positioned inside of the product storage passage. When the tip end 522 is positioned inside of the product storage passage, the tip end 522 is positioned in front of the second product following the foremost one.

The second gate member 52 includes a second engaging portion 523 protruding to the left. The second engaging portion 523 is kept inside of and latched onto a recess on the first engaging portion 513 of the first gate member 51.

Because the second gate member 52 is connected to the first gate member 51 via the leaf spring member 53, the second gate member 52 is basically rotated integrally with the first gate member 51. However, when a force causing the tip end 522 to retreat from the product storage passage is applied to the tip end 522, the second gate member 52 is rotated upwardly against the biasing force of the leaf spring member 53.

The product storage column 31 is provided with a pusher member 40 and a removal detecting sensor 5 (see FIG. 2).

The pusher member 40 is provided in a manner inserted into the product storage passage. As illustrated in FIG. 12, the pusher member 40 is always biased frontwardly by a pair of right and left spiral spring members 41. The tip end of each of these spiral spring members 41 is provided in a manner fixed to the tip end of each of the rail members 32. The pusher member 40 abuts against and presses the rearmost product, among the products stored in the product storage passage, to the front side. In this manner, all of the products are stored in the product storage passage in a manner pressed to the front side.

The removal detecting sensor 5 is provided at a position more to the front than the tip end 512 of the first gate member 51 positioned inside of the product storage passage. The removal detecting sensor 5 is a photosensor, for example, and detects a product that passes through a predetermined monitored area, and transmits a detection signal which is a detection result to the control unit 100.

Figure 13:
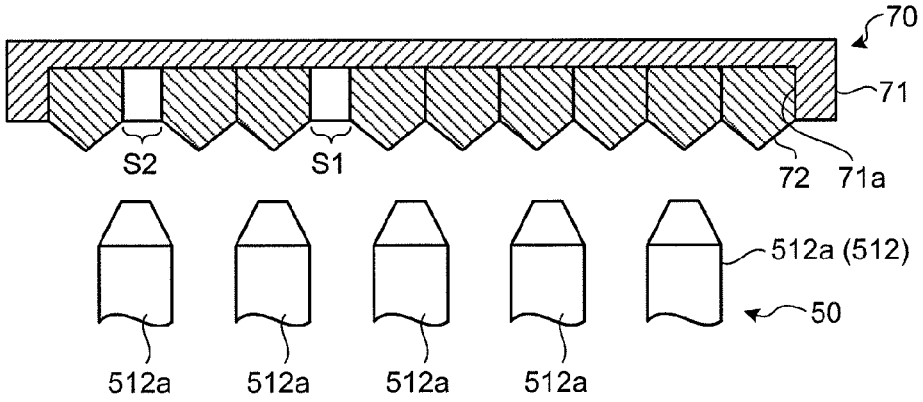
FIG. 13 is a schematic for generally explaining a restricting unit included in the product storage device illustrated in FIG. 3.
Figure 13:
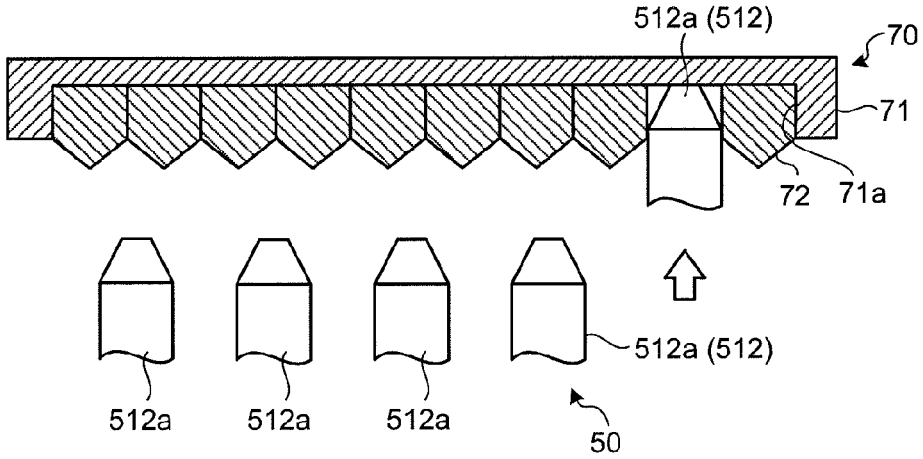

FIG. 13 is a schematic for generally explaining the restricting unit 70 included in the product storage device 20 illustrated in FIG. 3. The restricting unit 70 includes a guide member 71 and piece members 72. The guide member 71 is provided in a manner extending in the horizontal direction on the upper front side of each of the product storage columns 31 in each of the product racks 30*a* to 30*d*.

A plurality of the piece members 72 are provided. These piece members 72 are housed in a housing section 71*a* in the guide member 71 in a manner so that each of the piece members slides in the horizontal direction. The sum of the width of a space S1 and the width of a space S2 formed in the housing section 71*a* of the restricting unit 70 is slightly larger than the width of a protrusion 512*a* on the first gate member 51 provided to the releasing mechanism 50.

Therefore, as illustrated in (b) in FIG. 13, when the protrusion 512*a* on the first gate member 51 in one of the releasing mechanisms 50 provided to the respective product storage columns 31 is positioned inside of the housing section 71*a*, the housing section 71*a* no longer has any space for allowing the protrusion 512*a* on the first gate member 51 in another releasing mechanism 50 to enter.

When the protrusion 512*a* on the tip end 512 of one of the first gate members 51 being caused to retreat from the product storage passage correspondingly to an operation of taking out a product is positioned inside of the housing section 71*a*, the restricting unit 70 prohibits the protrusion 512*a* on the tip end 512 of the first gate member 51 provided to another releasing mechanism 50 from entering the housing section 71*a*, and restricts an upward rotation of the first gate member 51 provided to the other releasing mechanism 50.

Figure 14:
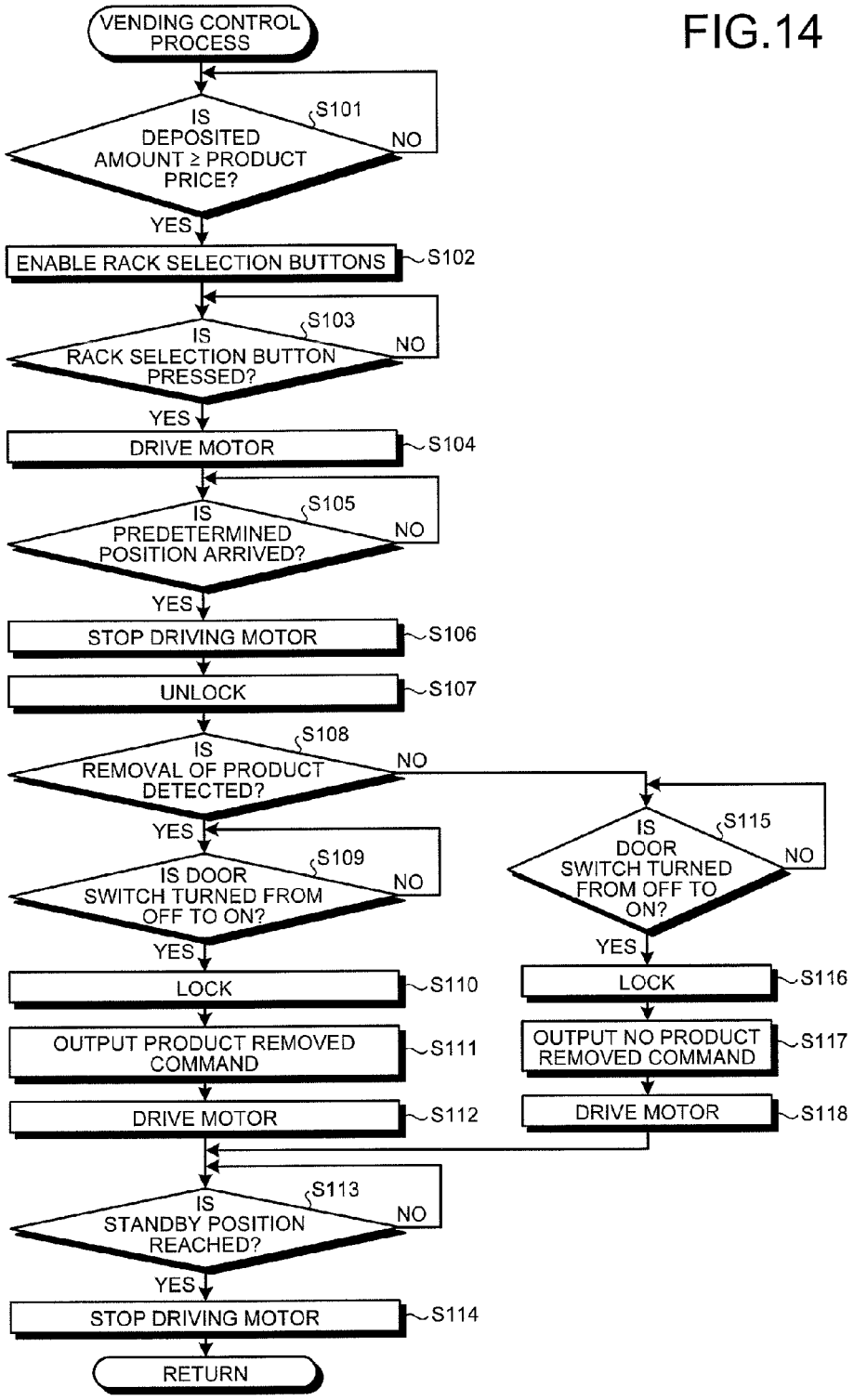
FIG. 14 is a flowchart illustrating a main part of a vending control process performed by the control unit illustrated in FIG. 2.

FIG. 14 is a flowchart illustrating a main part of a vending control process performed by the control unit 100 illustrated in FIG. 2. While explaining the vending control process, an operation of the automatic vending machine provided with the product storage device 20 will be also explained.

In the vending control process, when the deposited amount (amount information) provided from the currency processing device 15 is equal to or more than a product price (Yes at Step S101), the control unit 100 enables the rack selection buttons 14 (Step S102).

When the rack selection button 14 associated with the top product rack 30*a* is pressed, among the rack selection buttons 14 thus enabled (Yes at Step S103), the control unit 100 considers that a vending command is provided and drives the motor M (Step S104). At the timing at which the mode detection switch 64 detects the "60-degree-rotated position" (Yes at Step S105), the control unit 100 stops driving the motor M, and drives and unlocks the locking and unlocking mechanism 3 (Step S106 and Step S107). The user is then allowed to open the external door 2.

Figure 15:
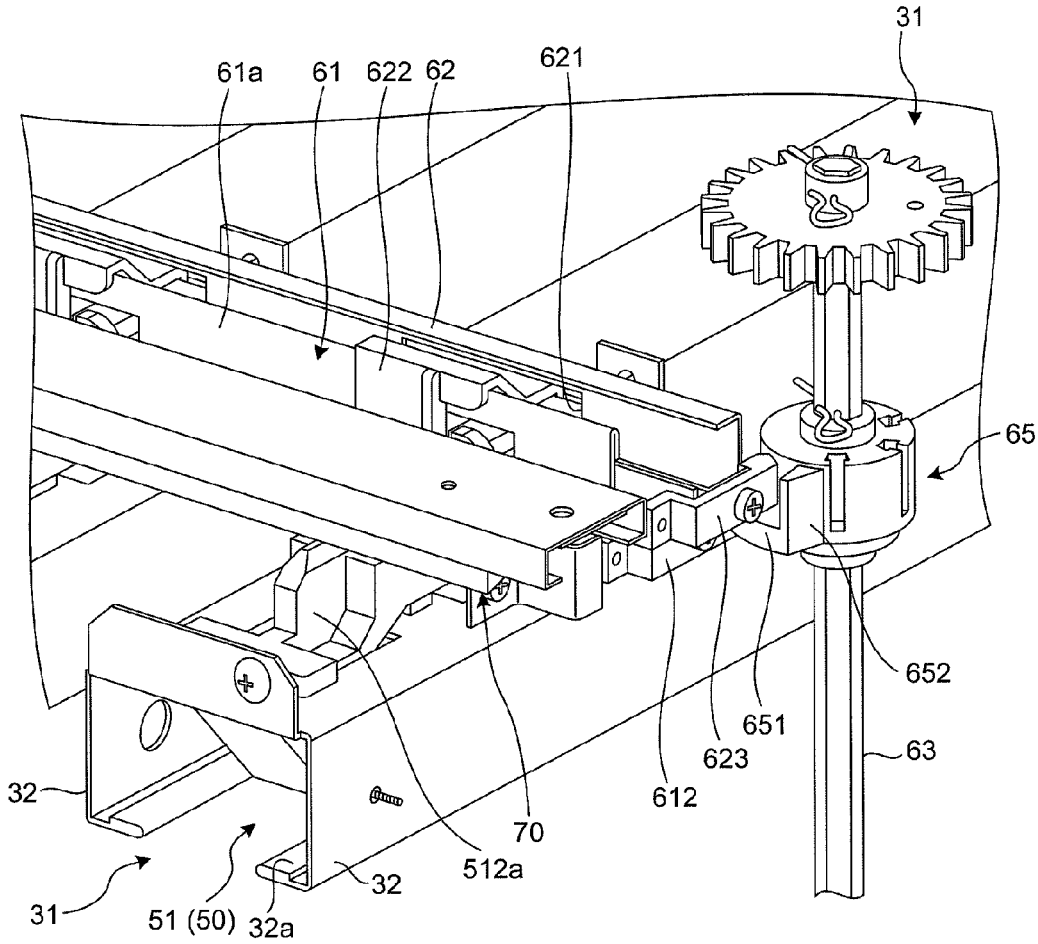
FIG. 15 is a perspective view illustrating a first sliding plate having moved to the left side.
Figure 16:
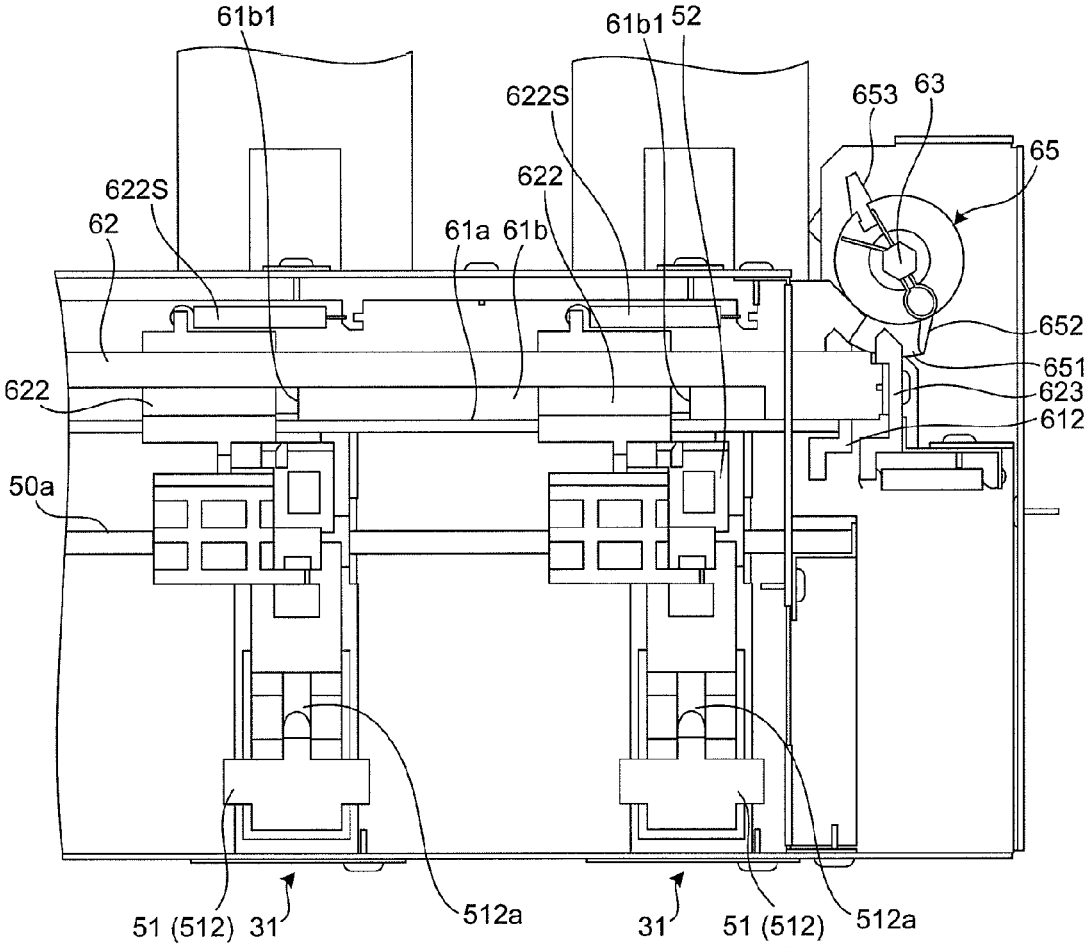
FIG. 16 is a plan view illustrating the first sliding plate having moved to the left side and against which the topmost switching cam member abuts.

Because the support rod 63 is stopped at the "60-degree-rotated position", the support rod 63 is rotated by 60 degrees from the "standby position" in the clockwise direction, and the first protrusion 651 on the topmost switching cam member 65 abuts against a first slide abutting portion 612 of the first sliding plate 61. The first sliding plate 61 is then moved to the left against the biasing force of the first spring member 61S (see FIGS. 15 and 16).

When the first sliding plate 61 is moved to the left, the cutout 61*b*1 on the first sliding plate 61 is moved to a position under the first engaging portion 513 on the first gate member 51, and an open space is formed under the first engaging portion 513. The first gate member 51 in each of the releasing mechanisms 50 in the top product rack 30*a* becomes free to rotate and allowed to be rotated upwardly, although a biasing force is applied to the first gate member 51 by the gate spring member.

In the product racks 30*b* to 30*d* other than the top product rack 30*a*, the switching cam members 65 mounted at the height levels corresponding to the respective product racks 30*b* to 30*d* do not abut against the respective first slide abutting portions 612. Therefore, the first gate member 51 in the releasing mechanism 50 in each of the product storage columns 31 is restricted by the first sliding plate 61 in the product racks 30*b* to 30*d* other than the topmost one. Therefore, any product stored in each of the product storage columns 31 in the product racks 30*b* to 30*d* cannot be taken out.

In the standby condition, the rack selecting mechanism 60 prohibits all of the product racks 30*a* to 30*d* from releasing a product. When a vending command is provided, the rack selecting mechanism 60 only allows the designated product rack 30*a* to release a product.

Figure 17:
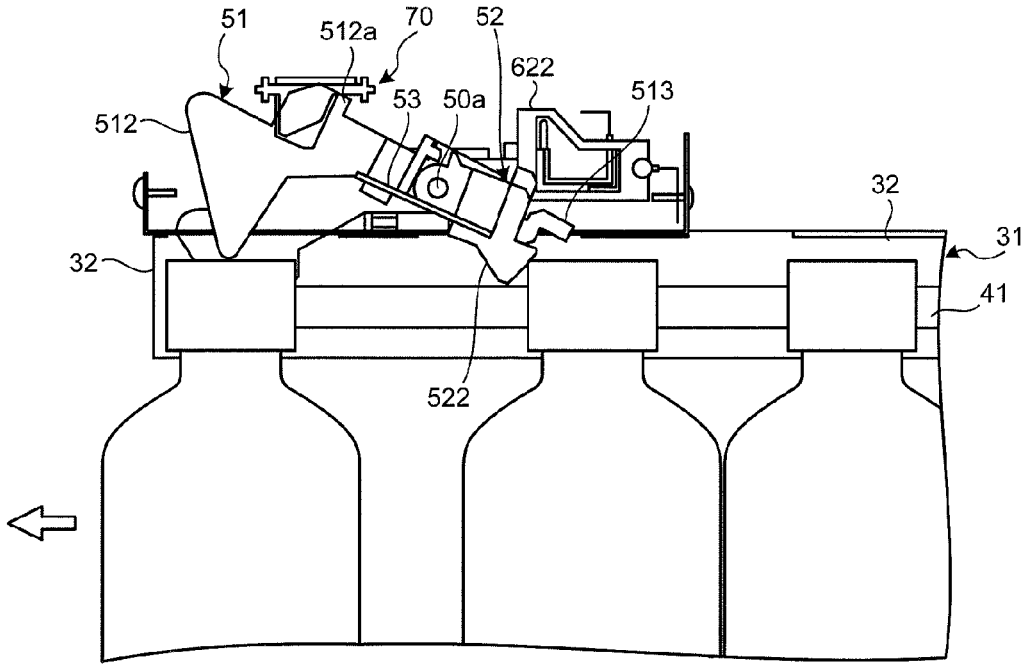
FIG. 17 is a schematic for explaining a configuration of when an operation of taking out the foremost product is performed.

When a user makes an operation of taking out a product by holding and pulling the body 200*d* of the foremost product that is stored in the second product storage column 31 from the right in the product rack 30*a*, for example, the releasing mechanism 50 operates in the manner described below. As illustrated in FIG. 17, the first gate member 51 is rotated upwardly in a manner causing the tip end 512 to retreat from the product storage passage against the biasing force of the gate spring member. At this time, the second gate member 52 is also rotated downwardly integrally with the first gate member 51 in a manner causing the tip end 522 to enter the product storage passage. This operation brings the tip end 522 of the second gate member 52 to a position between the foremost product currently being taken out and the second product that follows the foremost product.

Figure 18:
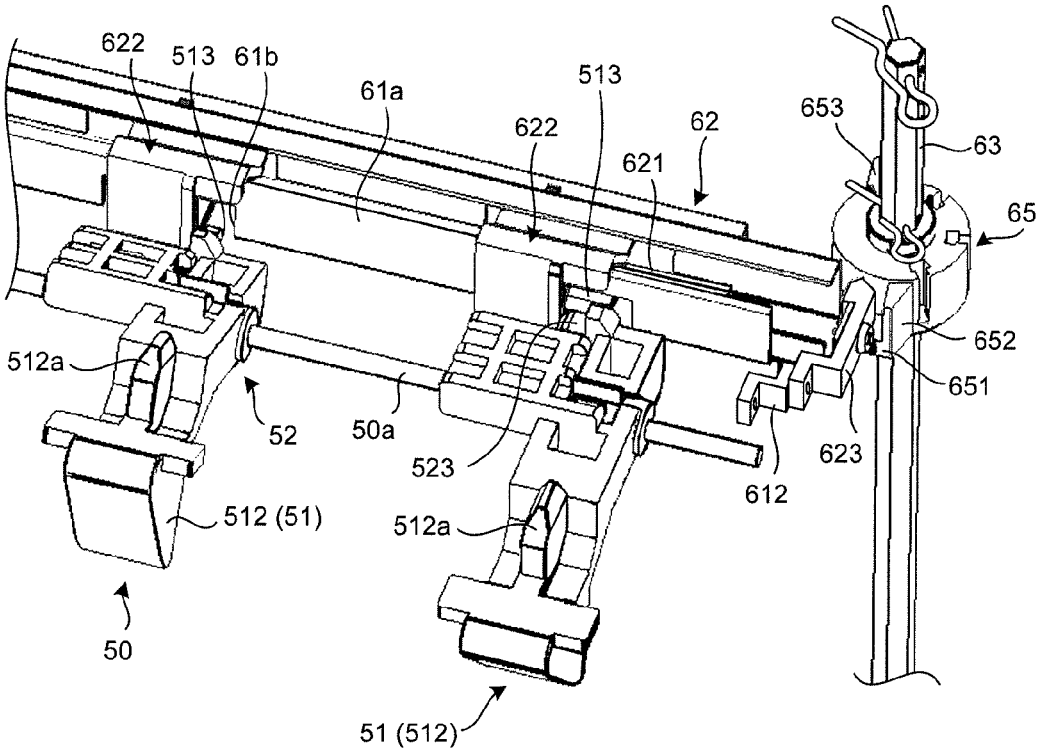
FIG. 18 is a perspective view illustrating a lock member having moved to a position above the second gate member.
Figure 19:
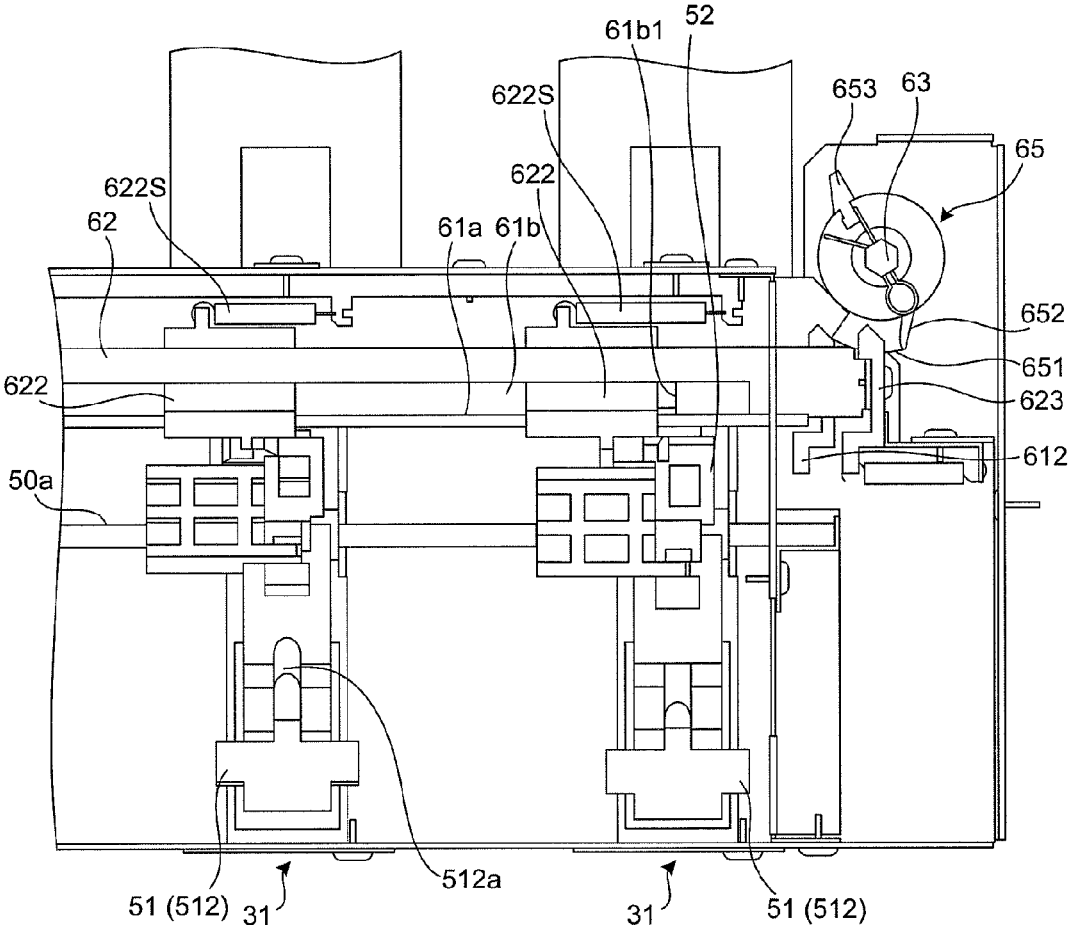
FIG. 19 is a plan view illustrating the lock member having moved to a position above the second gate member.

When the second gate member 52 is rotated downwardly, the first gate member 51 on the left side is rotated upwardly, as illustrated in FIGS. 18 and 19, and the lock member 622 is caused to move to the right by the biasing force of the lock spring member 622S. The lock member 622 then comes to be positioned on top of the second engaging portion 523 on the second gate member 52, holding the second gate member 52 in an orientation rotated downwardly. The first gate member 51 is also kept in an orientation rotated upwardly. Therefore, the second product following the foremost product and the subsequent products are not allowed to move to the front, and a plurality of products are prevented from being taken out to the front side from the same product storage column 31.

The protrusion 512*a* on the tip end 512 of the first gate member 51 rotated upwardly is positioned inside of the housing section 71*a* in the guide member 71 provided to the restricting unit 70. Therefore, the piece members 72 prevent the protrusion 512*a* on the first gate member 51 in the releasing mechanism 50 provided to another product storage column 31 in the top product rack 30*a* from entering the housing section 71*a* in the guide member 71, and, as a result, the first gate member 51 becomes incapable of rotating upwardly. Therefore, a product can be prevented from being taken out from the other product storage columns 31 in the same product rack 30*a*.

When the user takes out the foremost product from the predetermined product storage column 31, the removal detecting sensor 5 provided to the product storage column 31 detects the operation, and provides a detection signal to the control unit 100.

When the detection signal is received from the removal detecting sensor 5, and the external door 2 is closed to switch the door switch 4 from the OFF state to the ON state (Yes at Step S108, Yes at Step S109), the control unit 100 can recognize that the opening on the front side of the vendor cabinet 1 is closed after a product is removed.

The control unit 100 recognizing the closure drives the locking and unlocking mechanism 3 to be a lock state, outputs a product removed command to the currency processing device 15, and issues a product removed command to the motor M to drive the motor M (Step S110, Step S111, Step S112).

The currency processing device 15 receiving the product removed command output from the control unit 100 returns the change, if any, into the coin return 16, and stores the currencies in the amount of the product price in a manner sorted by the currency type.

The motor M is driven to rotate the support rod 63 in the clockwise direction until the support rod 63 reaches the "standby position" which is the predetermined stop position.

Figure 20:
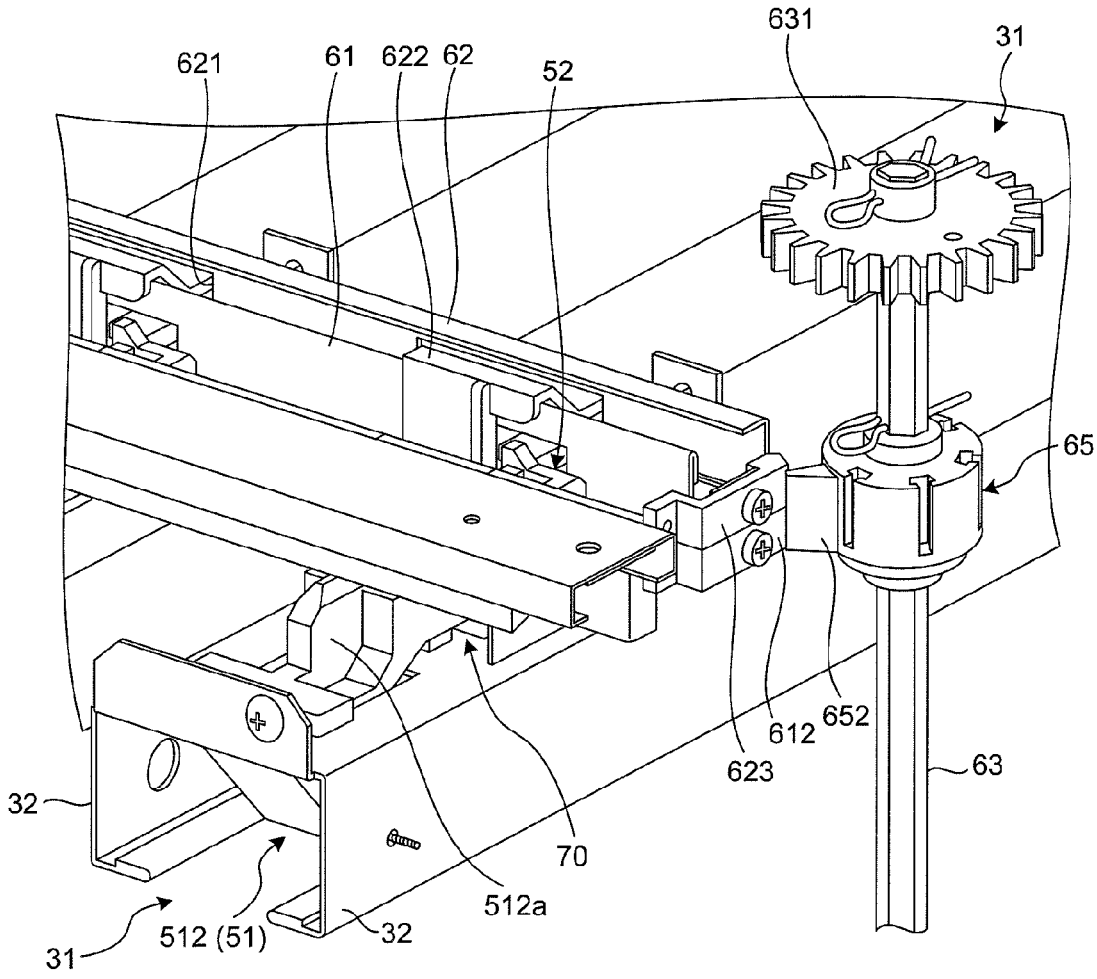
FIG. 20 is a perspective view illustrating the first sliding plate and the second sliding plate having moved to the left side.
Figure 21:
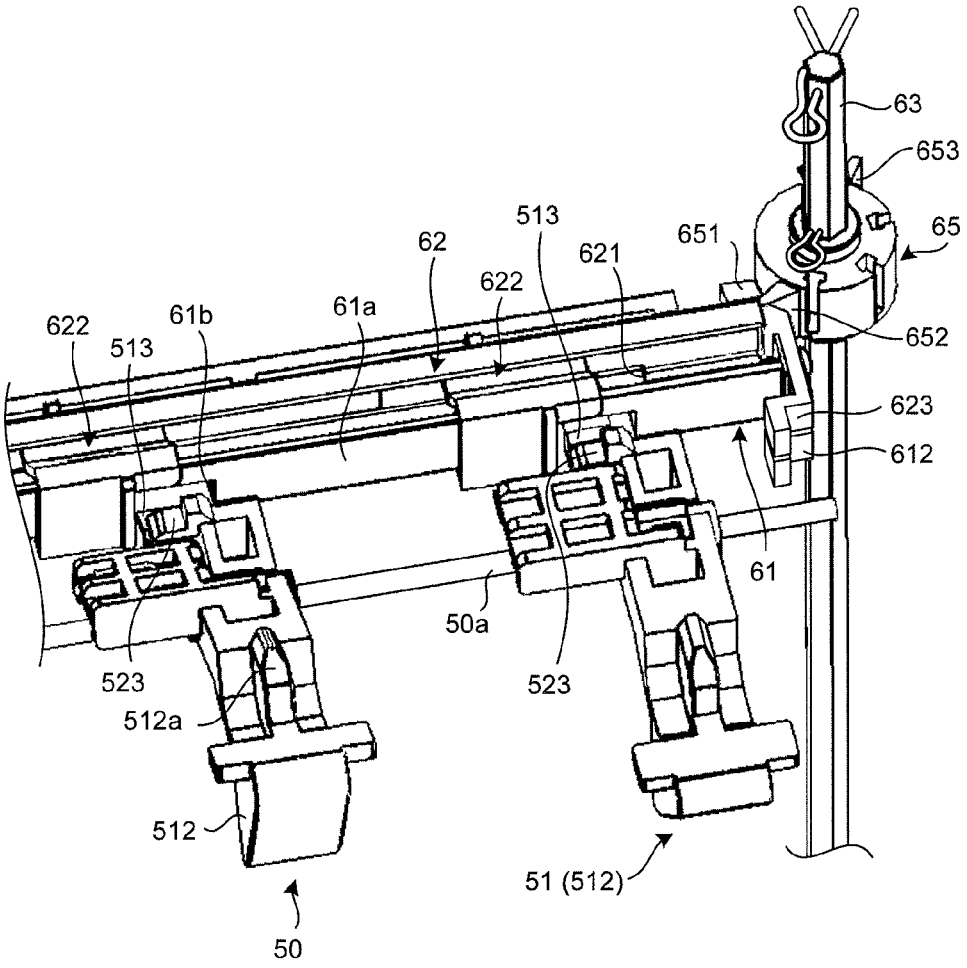
FIG. 21 is a perspective view illustrating an extraction of the first sliding plate and the second sliding plate having moved to the left side.
Figure 22:
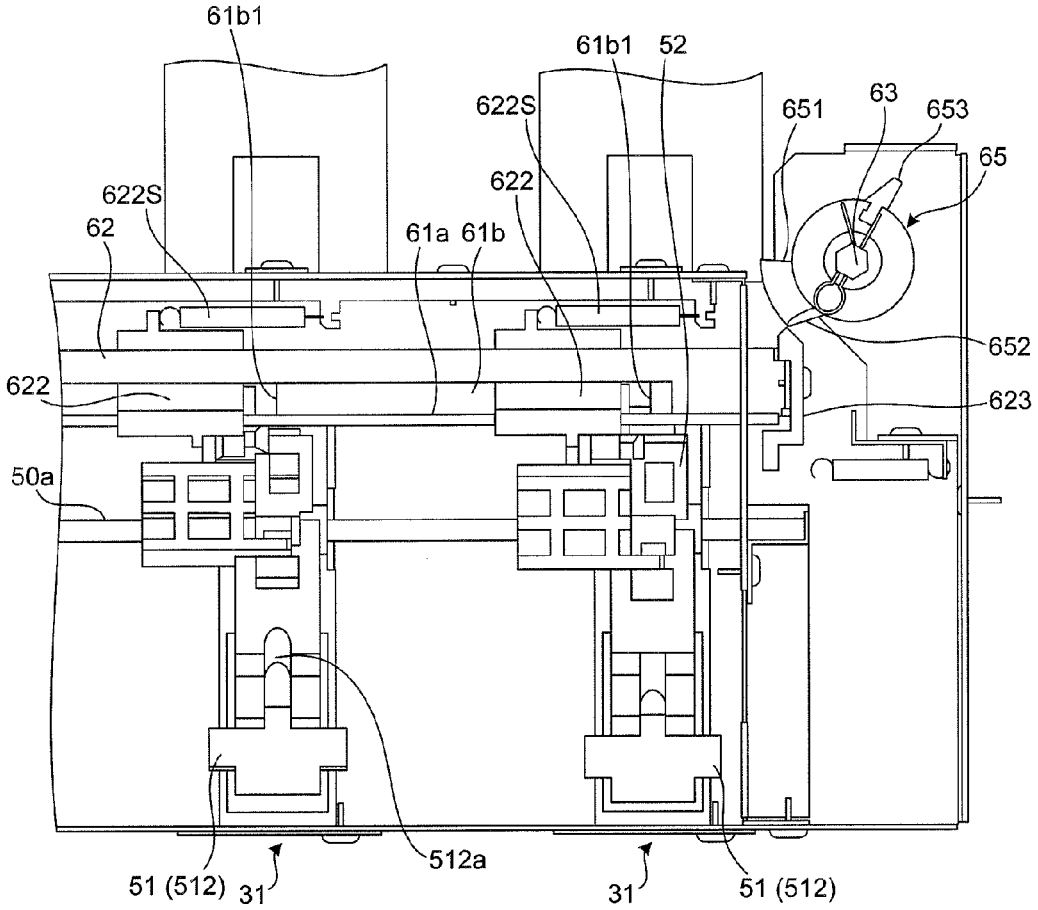
FIG. 22 is a plan view illustrating the first sliding plate and the second sliding plate having moved to the left side.

By the rotation of the support rod 63, the second protrusion 652 connected with the first protrusion 651 on the topmost switching cam member 65 is caused to abut against a second slide abutting portion 623 which is the right end of the second sliding plate 62. This operation causes the second sliding plate 62 to move to the left against the biasing force of the second spring member 62S (see FIGS. 20 to 22). When the second sliding plate 62 is moved to the left, the lock member 622 is caused to move to the left, and is removed from the position on the top of the second gate member 52. In this manner, an open space is formed above the second gate member 52. The first gate member 51 is then caused to rotate downwardly and the second gate member 52 is caused to rotate upwardly by the biasing force of the gate spring member. The tip end 512 of the first gate member 51 is then brought into the product storage passage, and the tip end 522 of the second gate member 52 is caused to retreat from the product storage passage. The pusher member 40 is then caused to push the products stored in the product storage passage to the front side.

When the second protrusion 652 of the topmost switching cam member 65 is caused to separate from the first slide abutting portion 612 and the second slide abutting portion 623 by the rotation of the support rod 63, the first sliding plate 61 and the second sliding plate 62 are caused to move to the right to the respective original positions, by the biasing forces of the first spring member 61S and the second spring member 62S, respectively. The left edge of the cutout 61*b*1 on the first sliding plate 61 is then carried to a position under the first engaging portion 513 of the first gate member 51. Therefore, the first gate member 51 becomes incapable of rotating upwardly.

When the mode detection switch 64 detects the predetermined position which is the "standby position" (Yes at Step S113), the control unit 100 stops driving the motor M (Step S114), returns the process to the start, and ends the current process. In this manner, it is possible to sell one product selected by a user.

At Step S108, when the door switch 4 is switched from the OFF state to the ON state without receiving any detection signal from the removal detecting sensor 5 (No at Step S108, Yes at Step S115), the control unit 100 can recognize that the opening on the front side of the vendor cabinet 1 is closed without any product removed.

The control unit 100 making the recognition drives the locking and unlocking mechanism 3 to be the lock state, and outputs a no product removed command to the currency processing device 15 (Step S116, Step S117). The currency processing device 15 receiving the no product removed command output from the control unit 100 returns the deposited coin into the coin return 16.

The control unit 100 having output the no product removed command issues a product removed command to the motor M to drive the motor M (Step S118), performs Step S113 and Step S114 described above, returns the process to the start, and ends the current process.

An example in which a product is refilled to the automatic vending machine will be explained. In such a case, the control unit 100 drives the motor M until the mode detection switch 64 detects "300-degree-rotated position". The third protrusions 653 on all of the switching cam members 65 are caused to abut against the respective first slide abutting portions 612 and the second slide abutting portions 623, further causing the first sliding plates 61 and the second sliding plate 62 to move to the left against the biasing force of the respective first spring members 61S and the second spring members 62S. In this manner, the first gate members 51 in the releasing mechanisms 50 are permitted to be rotated upwardly.

Figure 23:
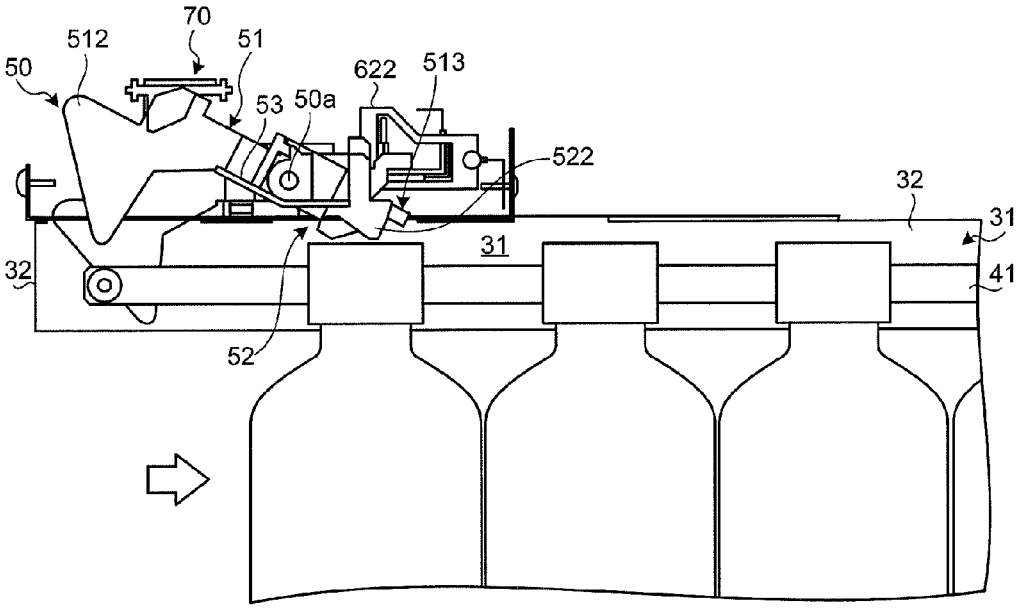
FIG. 23 is a schematic for explaining a situation in which products are refilled into the product storage column.

The first gate member 51 is then rotated upwardly, and a refill product is inserted into the product storage passage from the front side of the product storage column 31, as illustrated in FIG. 23. At this time, the product thus inserted is caused to abut against the tip end 522 of the second gate member 52, but because the second gate member 52 is not prevented from rotating by the lock member 622, the second gate member 52 is rotated upwardly against the biasing force of the leaf spring member 53, and the tip end 522 is caused to retreat from the product storage passage. Therefore, a predetermined number of products can be inserted and refilled from the front side of the product storage column 31.

In the above-described automatic vending machine, a product is taken out from the product rack storing therein canned-beverage products (the third product rack 30*c* from the top and the bottommost product rack 30*d*) in the manner described below. In the explanation, the bottommost product rack 30*d* is used as an example.

Figure 24:
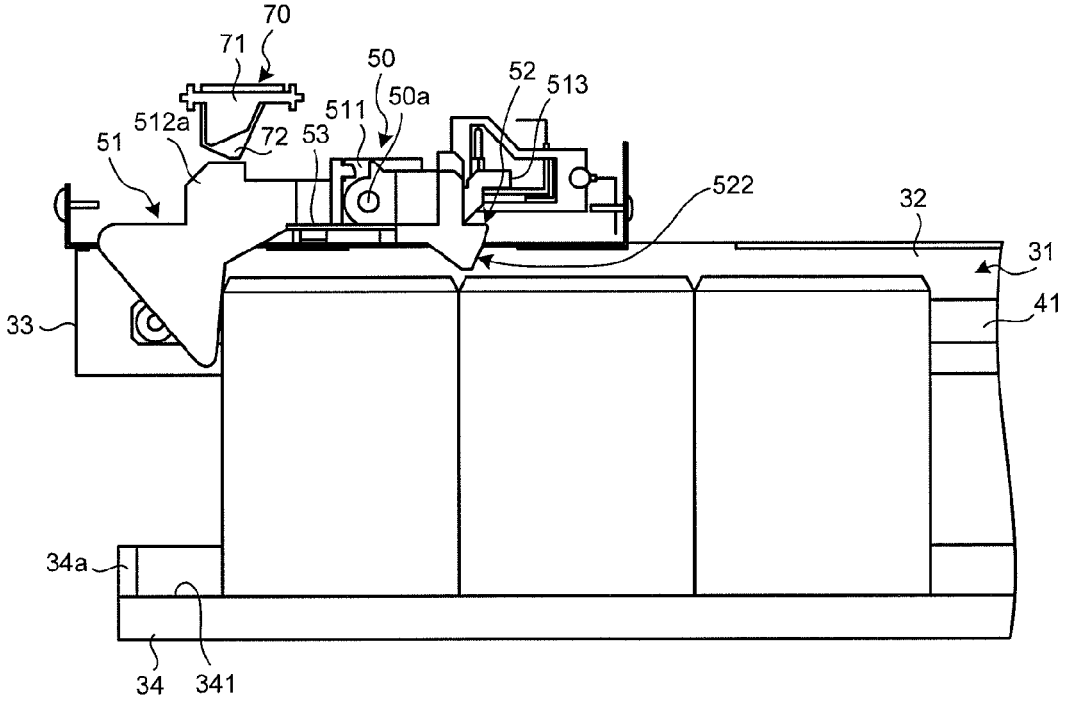
FIG. 24 is an explanatory schematic generally illustrating a product storage column storing therein canned-beverage products.

As illustrated in FIG. 24, products are stored in the product storage passage in a manner lined along the front-and-rear direction, while the horizontal movements of the products placed on the setting member 34 are restricted by the guide members 33. When money is deposited and the rack selection buttons 14 is pressed, the first sliding plate 61 abutting against the first protrusion 651 on the switching cam member 65 is moved to the left. Once the first sliding plate 61 is moved to the left, the cutout 61*b*1 comes to a position under the first engaging portion 513 on the first gate member 51, and an open space is formed under the first engaging portion 513. The first gate member 51 in each of the releasing mechanisms 50 in the bottommost product rack 30*d* is then permitted to rotate upwardly.

Figure 25:
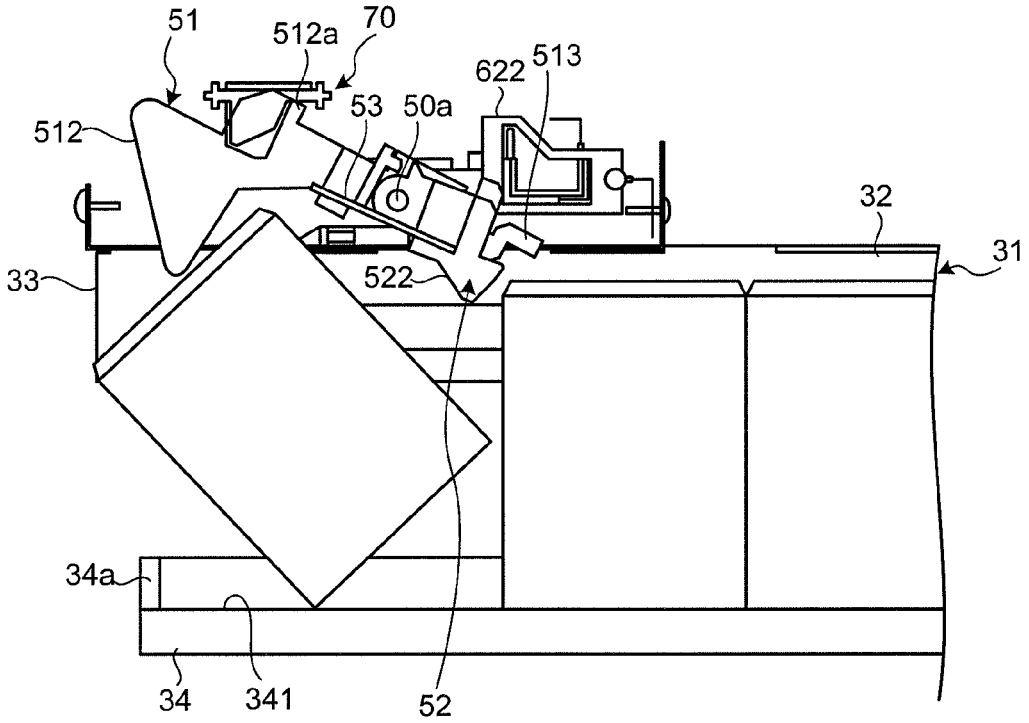
FIG. 25 is a schematic for explaining a situation in which an operation of taking out the foremost product is performed in the product storage column, illustrated in FIG. 24.

When the user makes an operation of taking out the foremost product stored in one of the product storage columns 31 in the product rack 30*d*, the automatic vending machine operates in the manner described below. Because the restricting member 34*a* is provided on the front end of the setting members 34, in the above-described operation of taking out a product, the user pulls out the foremost product by tilting the product toward the front side, as illustrated in FIG. 25. In other words, the restricting member 34*a* prevents the foremost product from being taken out simply by pulling out the product to the front side.

When the foremost product is pulled to the front side in a forwardly tilted orientation, the first gate member 51 is rotated upwardly, to cause the tip end 512 to retreat from the product storage passage against the biasing force of the gate spring member. The second gate member 52 is downwardly rotated integrally with the first gate member 51, and the tip end 522 is brought into the product storage passage. This operation brings the tip end 522 of the second gate member 52 to a position between the foremost product currently being taken out and the second product that follows the foremost product.

When the second gate member 52 is rotated downwardly, the lock member 622 is caused to move to the right by the biasing force of the lock spring member 622S. The lock member 622 is then positioned on top of the second gate member 52, and the second gate member 52 is kept in an orientation rotated downwardly. Therefore, the second product following the foremost product and the subsequent products are not allowed to move to the front, and a plurality of products are prevented from being taken out to the front side from the same product storage column 31.

The protrusion 512*a* on the tip end 512 of the first gate member 51 rotated upwardly is positioned inside of the housing section 71*a* in the guide member 71 provided to the restricting unit 70. The piece members 72 prevent the protrusion 512*a* on the first gate member 51 of the releasing mechanism 50 provided to another product storage column 31 in the top product rack 30*a* from entering the housing section 71*a* in the guide member 71, and, as a result, the first gate member 51 becomes incapable of rotating upwardly. Therefore, a product can be prevented from being taken out from the other product storage columns 31 in the same product rack 30*a*.

As explained above, in the automatic vending machine according to the first embodiment of the present invention, the rack selecting mechanism 60 in the standby position prohibits all of the product racks 30*a* to 30*d* from releasing a product. When a vending command is given, the rack selecting mechanism 60 permits only the designated product rack (30*a*) to release a product. The releasing mechanism 50 provided to each of the product storage columns 31 normally prevents a product stored in the product storage column 31 from being taken out. When the rack selecting mechanism 60 permits the product rack (30*a*) having the product storage column 31 to release a product, the releasing mechanism 50 operates correspondingly to an operation of taking out the product, and permits only the foremost product to be taken out. When the rack selecting mechanism 60 permits one of the product racks 30*a* to 30*d* each of which is provided with the restricting unit 70 to release a product, the restricting unit 70 provided to the one of the product racks 30*a* to 30*d* permits one of the releasing mechanisms 50 to operate, and prevents the other releasing mechanisms 50 provided to the one of the product racks 30*a* to 30*d* from operating. In this manner, a user is allowed to purchase a desired product without using a bucket driving unit in a manner practiced in a conventional automatic vending machine. Furthermore, the function of selling a product with no one attended, which is the function an automatic vending machine is originally intended for, can be provided. Furthermore, the structure can be simplified by assigning a part of a product vending operation to an operation of a user taking out a product. Therefore, the number of parts or the like can be reduced, and hence, the cost can be reduced.

Furthermore, in the automatic vending machine, because the product storage device 20 permits a user to take out one product at a time by holding the body 200*d*, the user can haptically check the degree by which the product is cooled or heated.

In the product storage device 20 provided to the automatic vending machine, because the first sliding plate 61 is normally positioned at the reference position and prevents the first gate member 51 from retreating from the product storage passage, the product stored in the product storage column 31 can be prevented from being taken out. Furthermore, by causing the switching cam member 65 to move the first sliding plate 61 from the reference position, the first gate member 51 and the second gate member 52 become free to rotate. When a user takes out the foremost product in the product storage passage in this configuration, the first gate member 51 is caused to retreat from the product storage passage, and the second gate member 52 is brought into the product storage passage. When the second gate member 52 is positioned inside of the product storage passage, the lock member 622 moves to a position on top of the second engaging portion 523 on the second gate member 52, and keeps the second gate member 52 in an orientation positioned inside of the product storage passage. In this manner, the second product that follows the foremost product is prevented from being moved to the front side. Furthermore, when the switching cam member 65 causes the second sliding plate 62 as well as the first sliding plate 61 to move from the respective reference positions, the lock member 622 can be carried away from the position on the top of the second engaging portion 523 on the second gate member 52, the first gate member 51 can be brought into the product storage passage, and the second gate member 52 can be caused to retreat from the product storage passage. By delegating an operation of taking out a product to a user, a need for using a bucket or a bucket driving unit, which are required in a conventional automatic vending machine, can be omitted, so that the costs can be reduced. Furthermore, because the second gate member 52 is positioned inside of the product storage passage even when the first gate member 51 is out of the product storage passage, only one product is permitted to be taken out at a time from the product storage column. Therefore, it can be ensured that only one product stored in the product storage column is taken out at a time, while enabling a cost reduction.

In the product storage device 20 provided to the automatic vending machine, because the rail members 32 provided to each of the product storage columns 31 support the cap fitting portion 200*b* of the product so that the product is stored in an upright orientation in a manner hanging in the product storage passage, a product contained in a container having the body 200*d* in a different shape, e.g., flat shape, can be stored fittingly, without causing product jamming.

In the product storage device 20 provided to the automatic vending machine, the setting members 34 provided to each of the product storage columns 31 allow a cylindrical product to be stored in the product storage passage in a manner sitting in an upright orientation, and thus a product contained in a container not enabled to be hanged by the rail members 32 can be stored fittingly without causing product jamming.

In the product storage device 20 provided to the automatic vending machine, when the protrusion 512*a* on one first gate member 51 rotates upwardly corresponding to an operation of taking out a product and enters the housing section 71*a*, the restricting unit 70 prevents the protrusion 512*a* on the first gate member 51 in another releasing mechanism 50 from entering the housing section 71*a*, and prevents a retreating movement of the first gate member 51 provided to the other releasing mechanism 50. Therefore, it can be ensured that a plurality of products are never taken out from any one of the product racks 30*a* to 30*d*.

In the product storage device 20 provided to the automatic vending machine, because a product is stored in the product storage passage in an upright orientation, a user can allowed to see the entire product, compared with when a product is stored in a horizontally laid orientation, and is allowed to be seen from the side of the cap, in the manner practiced in the conventional technology disclosed in Examined Patent Publication S50-27749, for example. In addition, because a user is allowed to see and touch the product to be purchased directly, the user is allowed to feel comfortable.

The exemplary first embodiment of the present invention is explained so far, but the present invention is not limited thereto, and various modifications are still possible.

Figure 26:
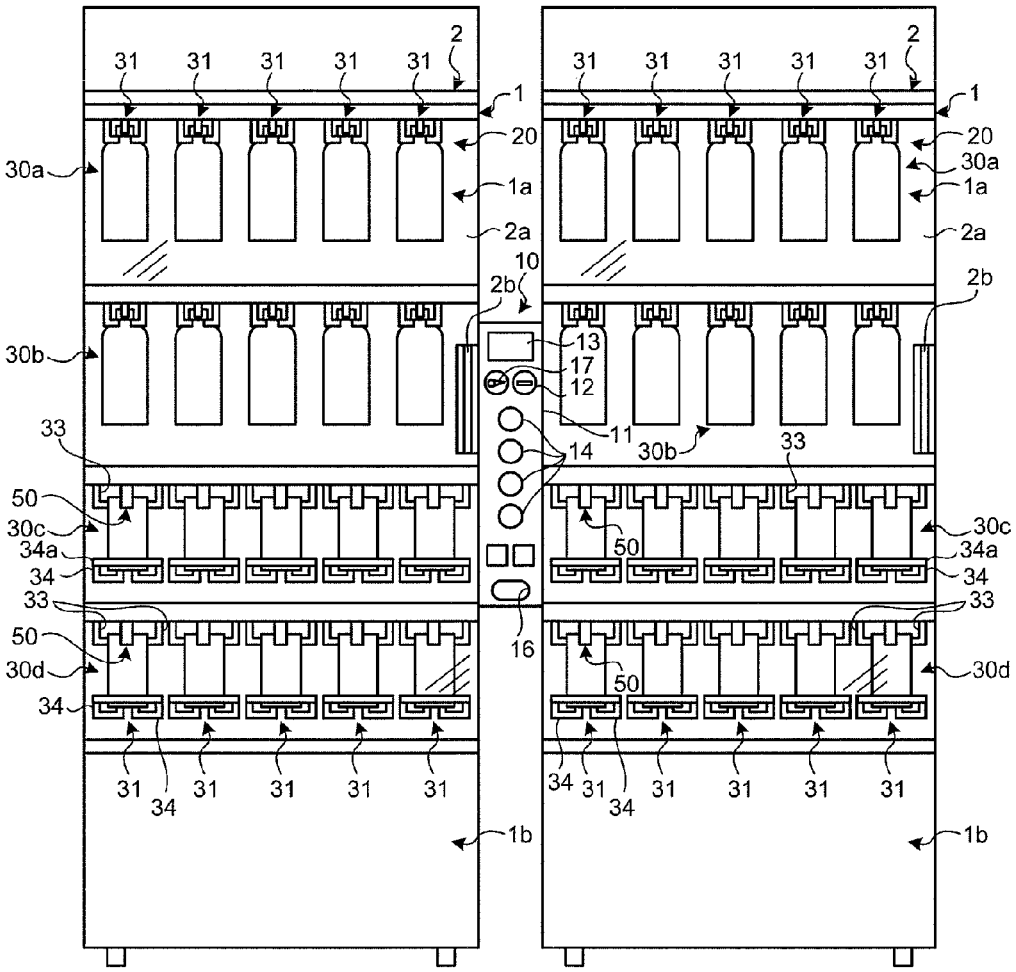
FIG. 26 is a front view illustrating an automatic vending machine according to a variation of the first embodiment of the present invention.

In the first embodiment explained above, the automatic vending machine includes one vendor cabinet 1 provided with one input processing unit 10. According to the present invention, it is also possible to provide an automatic vending machine in which one input processing unit 10 and a plurality of vendor cabinets 1 are connected, by communicatively connecting the input processing unit 10 and the vendor cabinets 1 not provided with any input processing unit, as illustrated in FIG. 26. This configuration also allows only one product desired by the user to be sold, and various types of products can be sold.

Second Embodiment

Figure 27:
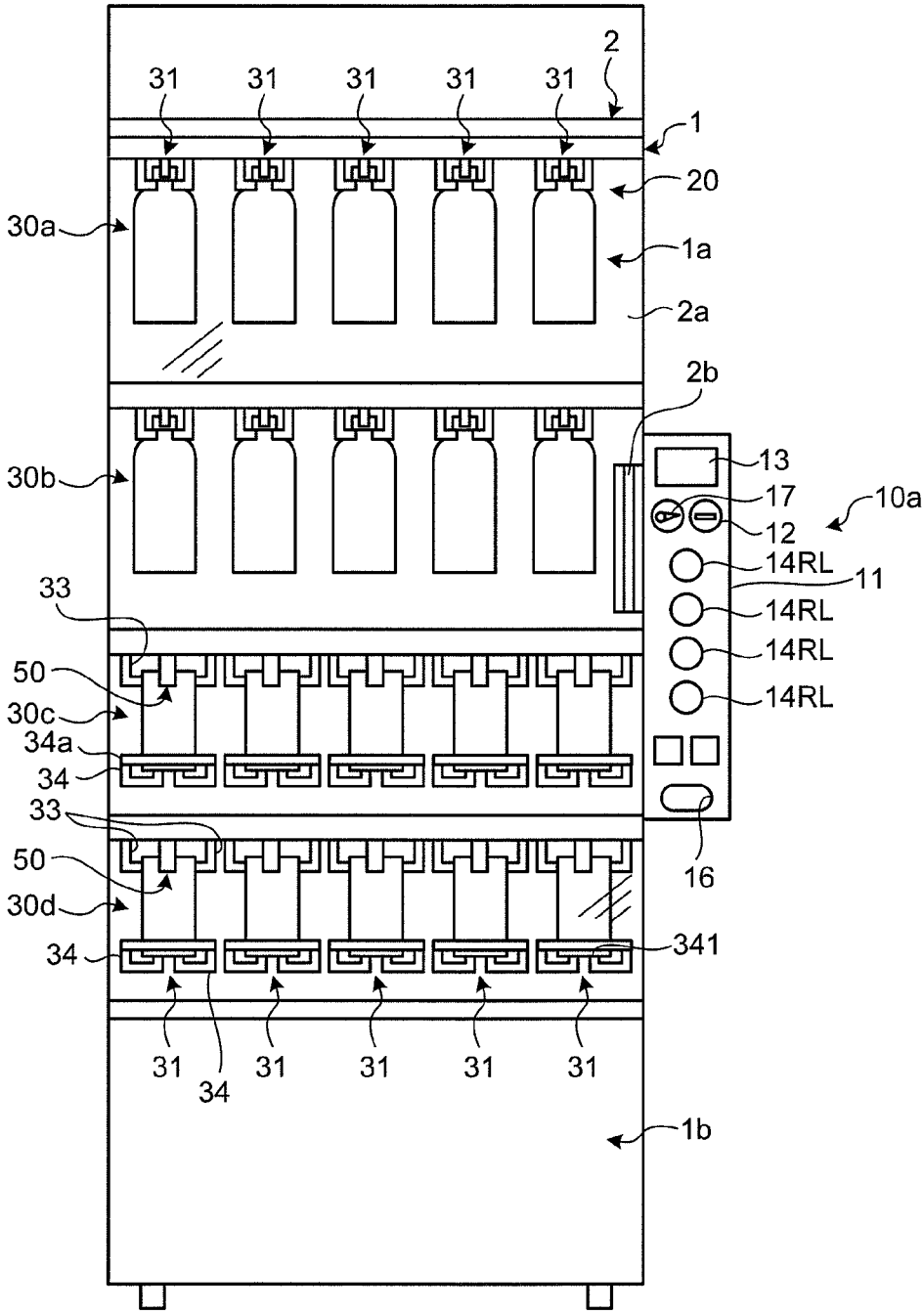
FIG. 27 is a front view illustrating an automatic vending machine according to a second embodiment of the present invention.
Figure 28:
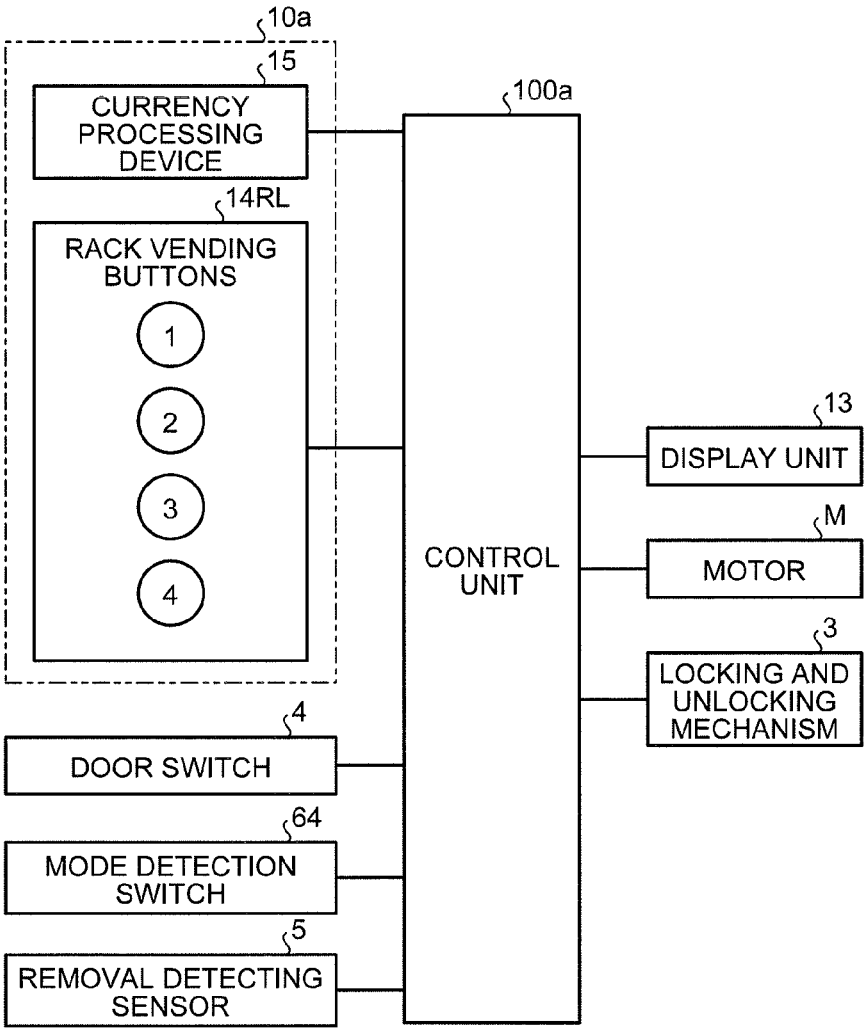
FIG. 28 is a block diagram illustrating a control system provided to the automatic vending machine according to a second embodiment of the present invention.

FIG. 27 is a front view illustrating an automatic vending machine according to a second embodiment of the present invention. FIG. 28 is a block diagram illustrating a control system provided to the automatic vending machine according to the second embodiment. Those having the same structure as those in the automatic vending machine according to the first embodiment described above are assigned with the same reference signs, and explanations thereof are omitted as appropriate.

The automatic vending machine explained herein as an example sells cooled or heated products such as canned-beverages or beverages in plastic bottles, and includes the vendor cabinet 1.

The vendor cabinet 1 is a housing having a cuboid shape, and the front side of which has an opening with the external door (door body) 2 that is opened and closed. An input processing unit 10*a* is mounted on the right side of the vendor cabinet 1. The input processing unit 10*a* includes the box-like main unit 11. The main unit 11 has a robust structure. On the front side of the main unit 11, the coin deposit slot 12, the display unit 13, rack vending lamps 14RL, and the like are provided.

A plurality (four in the example illustrated) of the rack vending lamps 14RL are provided in a manner lined horizontally. The rack vending lamps 14RL are associated with the respective product racks 30*a* to 30*d* provided to the product storage device 20, and turns ON in response to a command issued by a control unit 100*a* when the respective product racks 30*a* to 30*d* are enabled to sell a product.

The product storage device 20 includes the product racks 30*a* to 30*d*, the rack selecting mechanism 60, the releasing mechanism 50, and the restricting unit 70.

A plurality (four in the example illustrated) of the product racks 30*a* to 30*d* are provided. The product racks 30*a* to 30*d* are provided multiple levels along a vertical direction, in a manner extending between a pair of right and left rack supporting side boards not illustrated. In the second embodiment, the top product rack 30*a* and the second product rack 30*b* from the top store therein beverage products in plastic bottles, and have the same structure. The third product rack 30*c* from the top and the bottommost product rack 30*d* store therein canned-beverage products, and have the same structure. In the second embodiment, each of the product racks 30*a* to 30*d* stores therein the products of the same price.

Figure 29:
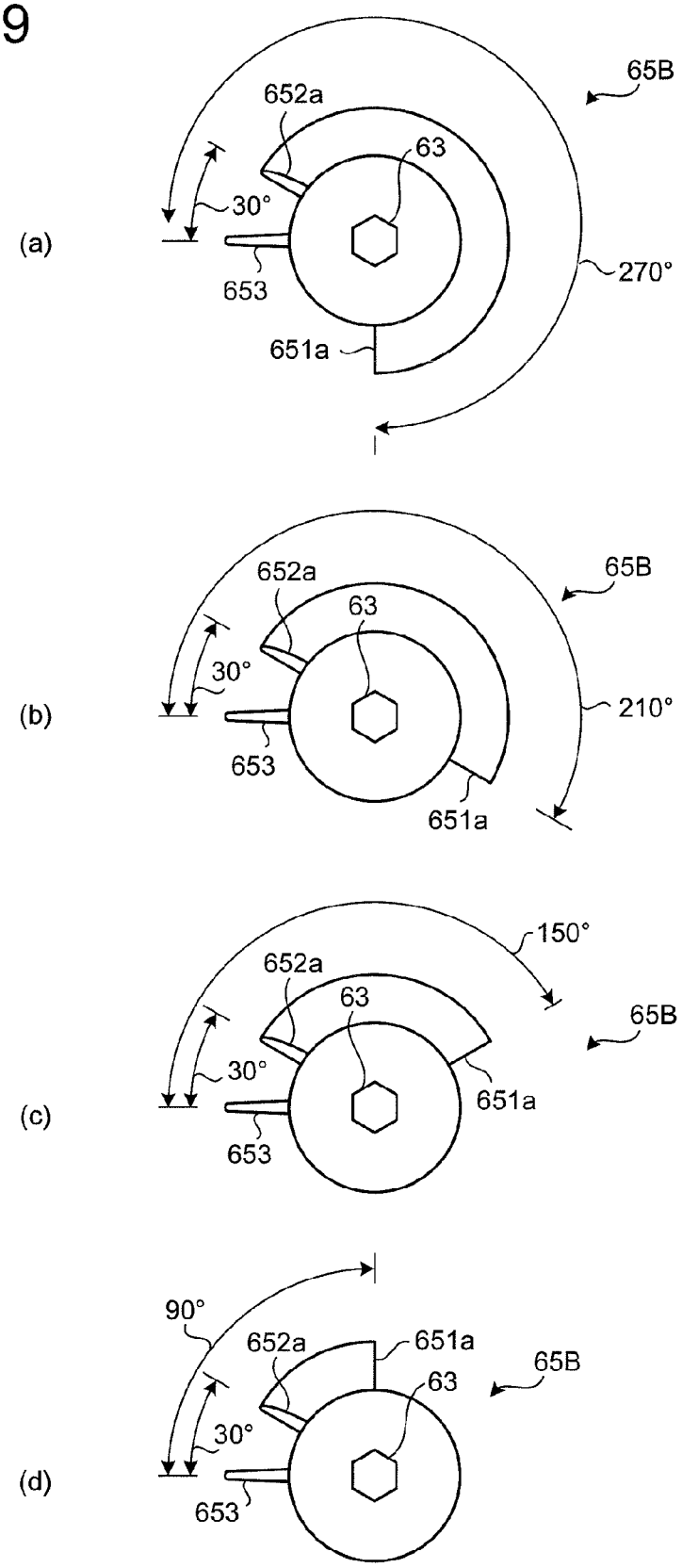
FIG. 29 is a plan view illustrating each switching cam member.

FIG. 29 is a schematic for explaining each switching cam member 65B supported by the support rod 63 provided to the rack selecting mechanism 60, viewed from the top. (a) in FIG. 29 illustrates the topmost switching cam member 65B. (b) in FIG. 29 illustrates the second switching cam member 65B from the top. (c) in FIG. 29 illustrates the third switching cam member 65B from the top. (d) in FIG. 29 illustrates the bottommost switching cam member 65B.

Each of the switching cam members 65B explained herein as an example is provided with a first protrusion 651*a*, a second protrusion 652*a*, and the third protrusion 653. The first protrusion 651*a* is provided on a lower part of the outer circumference of the switching cam member 65B, in a manner protruding outwardly in the radial direction. Each of the first protrusions 651*a* is provided by a predetermined angle in the clockwise direction with reference to the central axis of the switching cam member 65B (central axis of the support rod 63), for example.

The second protrusion 652*a* is provided to extend upwardly from an end of the first protrusion 651*a*. The third protrusion 653 is provided at a position interspaced from the second protrusion 652*a* by a predetermined angle in the counterclockwise direction with reference to the central axis (the central axis of the support rod 63), and extends in the vertical direction.

Each of these switching cam members 65B is explained below in detail. In the second switching cam member 65B from the top, the first protrusion 651*a* is provided at a position offset by 60 degrees with respect to the first protrusion 651*a* on topmost switching cam member 65B in the counterclockwise direction with reference to the central axis of the support rod 63.

In the third switching cam member 65B from the top, the first protrusion 651*a* is provided at a position offset by 60 degrees with respect to the first protrusion 651*a* on the second switching cam member 65B from the top in the counterclockwise direction with reference to the central axis of the support rod 63.

In the bottommost switching cam member 65B, the first protrusion 651*a* is provided at a position offset by 60 degrees with respect to the first protrusion 651*a* on the third switching cam member 65B from the top in the counterclockwise direction with reference to the central axis of the support rod 63.

The third protrusion 653 on the topmost switching cam member 65B is provided at a position offset by 270 degrees from an end of the first protrusion 651*a* on the switching cam member 65B in the counterclockwise direction with reference to the central axis of the support rod 63, and is provided at a position offset by 30 degrees from the second protrusion 652*a* in the counterclockwise direction with reference to the central axis of the support rod 63. The third protrusion 653 on the second switching cam member 65B from the top is provided at a position offset by 210 degrees from an end of the first protrusion 651*a* in the switching cam member 65B in the counterclockwise direction with reference to the central axis of the support rod 3, and is provided at a position offset by 30 degrees from the second protrusion 652*a* in the counterclockwise direction with reference to the central axis of the support rod 63. The third protrusion 653 on the third switching cam member 65B from the top is provided at a position offset by 150 degrees from an end of the first protrusion 651*a* in the switching cam member 65B in the counterclockwise direction with reference to the central axis of the support rod 3, and is provided at a position offset by 30 degrees from the second protrusion 652*a* in the counterclockwise direction with reference to the central axis of the support rod 63. The third protrusion 653 on the bottommost switching cam member 65B is provided at a position offset by 90 degrees from an end of the first protrusion 651*a* on the switching cam member 65B in the counterclockwise direction with reference to the central axis of the support rod 63, and is provided at a position offset by 30 degrees from the second protrusion 652*a* in the counterclockwise direction with reference to the central axis of the support rod 63.

In the manner described above, the topmost switching cam member 65B has the first protrusion 651*a* extending by 240 degrees with reference to the central axis of the support rod 63. The second switching cam member 65B from the top has the first protrusion 651*a* extending by 180 degrees with reference to the central axis of the support rod 63. The third switching cam member 65B from the top has the first protrusion 651*a* extending by 120 degrees with reference to the central axis of the support rod 63. The bottommost switching cam member 65B has the first protrusion 651*a* extending by 60 degrees with reference to the central axis of the support rod 63. The second protrusion 652*a* and the third protrusion 653 on one of the switching cam members 65B are provided in a manner aligned with those on the other switching cam members 65B, respectively, in the vertical direction.

Because each of these switching cam members 65B has that shape, the "standby position" detected by the mode detection switch 64 becomes the reference position, and is a position none of these switching cam members 65B abuts against the first sliding plate 61 and the second sliding plate 62.

The "60-degree-rotated position" detected by the mode detection switch 64 is a position at which the support rod 63 is rotated from the "standby position" by 60 degrees in the clockwise direction. At this position, the first protrusion 651*a* on the topmost switching cam member 65B abuts against the first sliding plate 61 provided to the top product rack 30*a*, and causes the first sliding plate 61 to move to the left.

The "120-degree-rotated position" detected by the mode detection switch 64 is a position at which the support rod 63 is rotated by 120 degrees in the clockwise direction. At this position, the topmost switching cam member 65B abuts against the first sliding plate 61 provided to the top product rack 30*a*, and causes the first sliding plate 61 to move to the left. The first protrusion 651*a* on the second switching cam member 65B from the top also abuts against the first sliding plate 61 in the second product rack 30*b* from the top, and causes the first sliding plate 61 to move to the left.

The "180-degree-rotated position" detected by the mode detection switch 64 is a position at which the support rod 63 is rotated by 180 degrees in the clockwise direction. At this position, the topmost switching cam member 65B abuts against the first sliding plate 61 provided to the top product rack 30*a*, and causes the first sliding plate 61 to move to the left. The first protrusion 651*a* on the second switching cam member 65B from the top also abuts against the first sliding plate 61 in the second product rack 30*b* from the top, and causes the first sliding plate 61 to move to the left. The first protrusion 651*a* on the third switching cam member 65B from the top also abuts against the first sliding plate 61 provided to the third product rack 30*c* from the top, and causes the first sliding plate 61 to move to the left.

The "240-degree-rotated position" detected by the mode detection switch 64 is a position at which the support rod 63 is rotated by 240 degrees in the clockwise direction. At this position, the topmost switching cam member 65B abuts against the first sliding plate 61 provided to the top product rack 30*a*, and causes the first sliding plate 61 to move to the left. The first protrusion 651*a* on the second switching cam member 65B from the top also abuts against the first sliding plate 61 in the second product rack 30*b* from the top, and causes the first sliding plate 61 to move to the left. The first protrusion 651*a* on the third switching cam member 65B from the top also abuts against the first sliding plate 61 provided to the third product rack 30*c* from the top, and causes the first sliding plate 61 to move to the left. The first protrusion 651*a* on the bottommost switching cam member 65B also abuts against the first sliding plate 61 provided to the bottommost product rack 30*d*, and causes the first sliding plate 61 to move to the left.

The "300-degree-rotated position" detected by the mode detection switch 64 is a position at which the support rod 63 is rotated by 300 degrees in the clockwise direction. At this position, the third protrusion 653 on all of the switching cam members 65B abuts against the respective first sliding plates 61 and the second sliding plates 62 provided to the respective product racks 30*a* to 30*d*, and causes these sliding plates to move to the left.

In other words, in the automatic vending machine according to the second embodiment, depending on the amount deposited, the cases can be classified as follows: a case in which a product is allowed to be taken out only from the top product rack 30*a*; a case in which a product is allowed to be taken out from the product racks 30*a* and 30*b*; a case in which a product is allowed to be taken out from the product racks 30*a* to 30*c*; and a case in which a product is allowed to be taken out from all of the product racks 30*a* to 30*d*.

Figure 30:
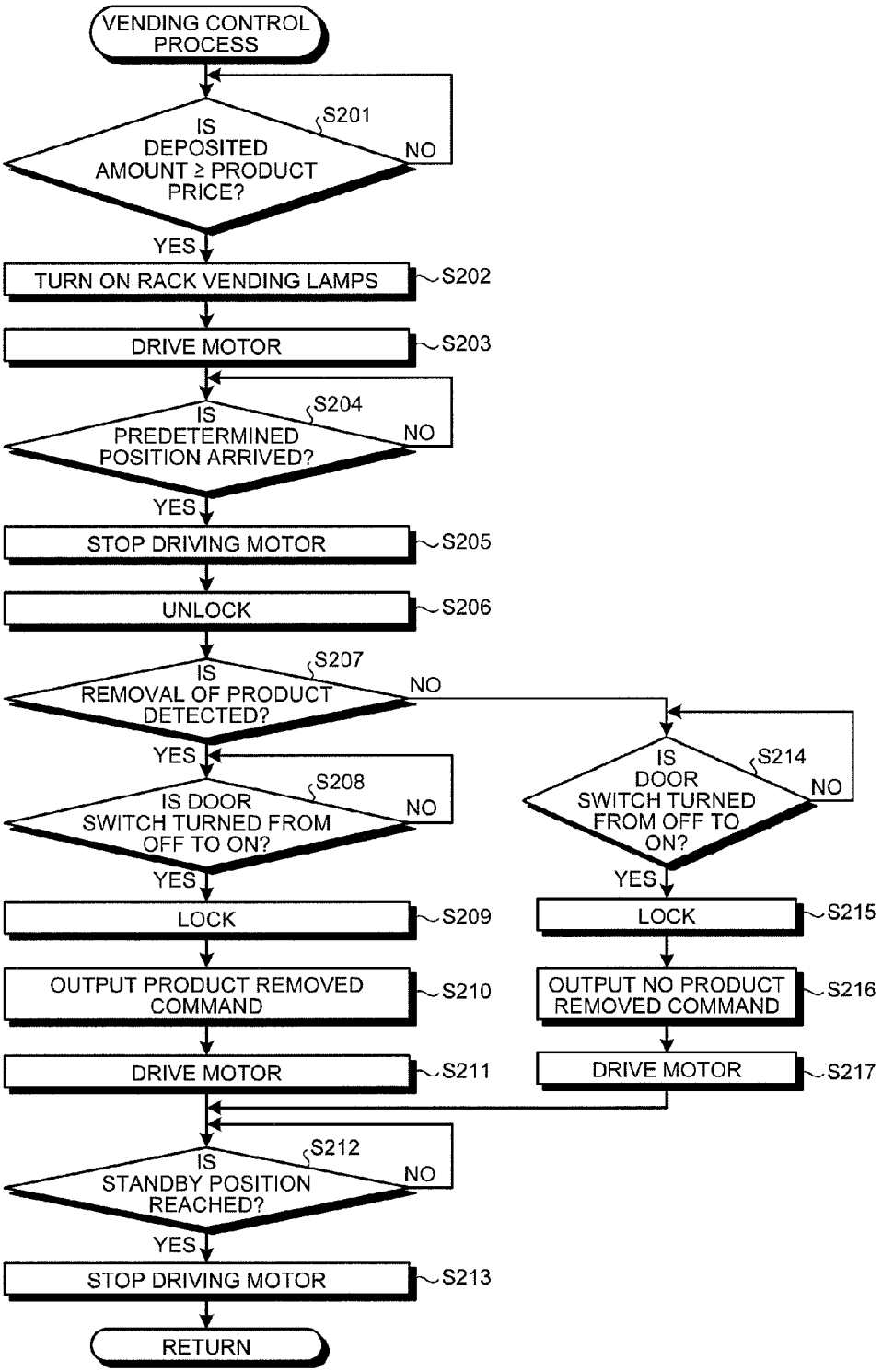
FIG. 30 is a flowchart illustrating a main part of a vending control process performed by the control unit illustrated in FIG. 28.

FIG. 30 is a flowchart illustrating a main part of a vending control process performed by the control unit 100*a* illustrated in FIG. 28. While explaining the vending control process, an operation of the automatic vending machine according to the second embodiment will be also explained.

In the vending control process, when the deposited amount (amount information) received from the currency processing device 15 is equal to or more than a product price (Yes at Step S201), the control unit 100*a* enables and turns ON the corresponding rack vending lamp 14RL (Step S202). To explain more specifically, the money deposited at Step S201 is equal to or more than products stored in the product racks 30*a* to 30*c*, the control unit 100*a* turns ON the rack vending lamps 14RL corresponding to the product racks 30*a* to 30*c*. In other words, at Step S201, the money deposited is not equal to or more than the price of a product stored in the bottommost product rack 30*d*. Therefore, the control unit 100*a* does not turn ON the rack vending lamp 14RL corresponding to the bottommost product rack 30*d*.

The control unit 100*a* having turned ON the corresponding rack vending lamps 14RL considers that a vending command is given, and drives the motor M (Step S203). When the mode detection switch 64 detects the "180-degree-rotated position" (Yes at Step S204), the control unit 100*a* stops driving the motor M, and drives the locking and unlocking mechanism 3 to unlock the external door 2 (Step S205, Step S206). This operation allows a user to open the external door 2.

Because the support rod 63 is stopped at "180-degree-rotated position", the support rod 63 has rotated by 180 degrees from the "standby position" in the clockwise direction, and the topmost switching cam member 65B abuts against the first sliding plate 61 in the top product rack 30*a*, and causes the first sliding plate 61 to move to the left. At the same time, the first protrusion 651*a* on the second switching cam member 65B from the top abuts against the first sliding plate 61 in the second product rack 30*b* from the top, and causes the first sliding plate 61 to move to the left. The first protrusion 651*a* on the third switching cam member 65B from the top also abuts against the first sliding plate 61 in the third product rack 30*c* from the top, and causes the first sliding plate 61 to move to the left.

Once the first sliding plates 61 are moved to the left, the cutout 61*b*1 on each of the first sliding plates 61 comes to a position under the first engaging portion 513 on the first gate member 51, and an open space is formed under the first engaging portion 513. The first gate member 51 in each of the releasing mechanisms 50 provided to the respective product racks 30*a* to 30*c* becomes free to rotate and allowed to be rotated upwardly, although the first gate member 51 is still biased by the gate spring member.

In the bottommost product rack 30*d* other than the product racks 30*a* to 30*c*, the switching cam member 65B mounted at the height level corresponding to the product rack 30*d* does not abut against the first slide abutting portion 612. Therefore, the first gate member 51 in the releasing mechanism 50 provided to each of the product storage columns 31 is restricted by the first sliding plate 61 in the bottommost product rack 30*d*. In this manner, a product stored in each of the product storage columns 31 in the product rack 30*d* is prevented from being taken out.

In the manner described above, the rack selecting mechanism 60 in the standby position prohibits all of the product racks 30*a* to 30*d* from releasing a product. When a vending command is given, the rack selecting mechanism 60 permits a designated one of the product rack 30*a* to 30*c* to release a product.

When the user performs an operation of taking out the foremost product stored in the second product storage column 31 from the right in the product rack 30*a*, for example, by holding the body 200*d* of the foremost product, the releasing mechanism 50 operates in the manner described below. The first gate member 51 is rotated upwardly against the biasing force of the gate spring member so that the tip end 512 is caused to retreat from the product storage passage. In such a case, the second gate member 52 is downwardly rotated integrally with the first gate member 51 so that the tip end 522 is brought into the product storage passage. This operation brings the tip end 522 of the second gate member 52 to a position between the foremost product currently being taken out and the second product following the foremost product.

When the second gate member 52 is rotated downwardly, the first gate member 51 on the left side is rotated upwardly, and the lock member 622 is moved to the right by the biasing force of the lock spring member 622S. The lock member 622 is then positioned on top of the second engaging portion 523 on the second gate member 52. In this manner, the second gate member 52 is kept in an orientation rotated downwardly. The first gate member 51 is also kept in an orientation rotated upwardly. Therefore, the second product following the foremost product and the subsequent products are not allowed to move to the front, and a plurality of products are prevented from being taken out to the front side from the same product storage column 31.

The protrusion 512*a* on the tip end 512 of the first gate member 51 rotated upwardly is positioned inside of the housing section 71*a* in the guide member 71 provided to the restricting unit 70. The piece members 72 prevent the protrusion 512*a* on the first gate member 51 of the releasing mechanism 50 provided to another product storage column 31 in the top product rack 30*a* from entering the housing section 71*a* in the guide member 71, and, as a result, the protrusion 512*a* becomes incapable of rotating upwardly. Therefore, a product can be prevented from being taken out from the other product storage columns 31 in the same product rack 30*a*.

When the user takes out the foremost product from the predetermined product storage column 31, the removal detecting sensor 5 provided to the product storage column 31 detects that the foremost product is removed, and provides a detection signal to the control unit 100*a*.

When a detection signal is received from the removal detecting sensor 5, and the external door 2 is closed subsequently, causing the door switch 4 to switch from the OFF state to the ON state (Yes at Step S207 and Yes at Step S208), the control unit 100*a* can recognize that the opening on the front side of the vendor cabinet 1 is closed after a product is removed.

The control unit 100*a* recognizing the closure drives the locking and unlocking mechanism 3 to be a lock state, outputs a product removed command to the currency processing device 15, and issues a product removed command to the motor M to drive the motor M (Step S209, Step S210, Step S211).

The currency processing device 15 receiving the product removed command output from the control unit 100*a* returns the change, if any, into the coin return 16, and stores the currencies in the amount of the product price in a manner sorted by the currency type.

The motor M is driven to rotate the support rod 63 in the clockwise direction until the support rod 63 reaches the "standby position" which is the predetermined stop position.

By the rotation of the support rod 63, the second protrusion 652*a* connected with the first protrusion 651*a* on the topmost switching cam member 65B is caused to abut against the second slide abutting portion 623 which is the right end of the second sliding plate 62. This operation causes the second sliding plate 62 to move to the left against the biasing force of the second spring member 62S. When the second sliding plate 62 is moved to the left, the lock member 622 is caused to move to the left, and is removed from the position on top of the second gate member 52. In this manner, an open space is formed above the second gate member 52. The first gate member 51 is then caused to rotate downwardly and the second gate member 52 is caused to rotate upwardly by the biasing force of the gate spring member. The tip end 512 of the first gate member 51 is then brought into the product storage passage, and the tip end 522 of the second gate member 52 is caused to retreat from the product storage passage. The pusher member 40 is then caused to push the products stored in the product storage passage to the front side.

As the support rod 63 is rotated, the second protrusion 652*a* on the switching cam member 65B is separated from the first slide abutting portion 612 and the second slide abutting portion 623, and the first sliding plate 61 and the second sliding plate 62 are caused to move to the right by the biasing force of the first spring member 61S and the second spring member 62S, respectively. The left edge of the cutout 61*b*1 on the first sliding plate 61 is then brought to a position under the first engaging portion 513 of the first gate member 51. Therefore, the first gate member 51 becomes incapable of rotating upwardly.

When the mode detection switch 64 detects the predetermined position which is the "standby position" (Yes at Step S212), the control unit 100*a* stops driving the motor M (Step S213), returns the process to the start, and ends the current process. In this manner, it is possible to sell one product selected by a user.

At Step S207, when the door switch 4 is switched from the OFF state to the ON state without receiving any detection signal from the removal detecting sensor 5 (No at Step S207 and Yes at Step S214), the control unit 100*a* can recognize that the opening on the front side of the vendor cabinet 1 is closed without any product removed.

The control unit 100*a* making such a recognition drives the locking and unlocking mechanism 3 to be a lock state, and outputs a no product removed command to the currency processing device 15 (Step S215, Step S216). The currency processing device 15 receiving the no product removed command output from the control unit 100*a* returns the deposited coin into the coin return 16.

The control unit 100*a* having output the no product removed command issues a product removed command to the motor M to drive the motor M (Step S217), performs the Step S212 and Step S213 described above, returns the process to the start, and ends the current process.

As explained above, in the automatic vending machine according to the second embodiment, the rack selecting mechanism 60 in the standby position prohibits all of the product racks 30*a* to 30*d* from releasing any products. When a vending command is given, the rack selecting mechanism 60 permits a designated product rack (30*a*, 30*b* or 30*c*) to release a product. The releasing mechanism 50 provided to each of the product storage columns 31 normally prevents a product stored in the product storage columns 31 from being taken out. When the rack selecting mechanism 60 permits the product rack (30*a*, 30*b* or 30*c*) having the product storage column 31 to release a product, the releasing mechanism 50 operates correspondingly to the operation of taking out the product, and permits only the foremost product to be taken out. When the rack selecting mechanism 60 permits one of the product racks 30*a* to 30*d* each of which is provided with the restricting unit 70 to release a product, the restricting units 70 provided to the one of the product racks 30*a* to 30*d* permits one of the releasing mechanisms 50 to operate, and prohibits the other releasing mechanisms 50 provided to the one of the product racks 30*a* to 30*d* from operating. In this manner, a user is allowed to purchase a desired product without using a bucket driving unit in a manner practiced in a conventional automatic vending machine. Furthermore, the function of selling a product with no one attended, which is the function an automatic vending machine is originally intended for, can be provided. Furthermore, the structure can be simplified by assigning a part of a product vending operation to an operation of a user taking out a product. Therefore, the number of parts or the like can be reduced, and hence, the cost can be reduced.

Furthermore, in the automatic vending machine described above, because the product storage device 20 permits a user to take out one product at a time by holding the body 200*d*, the user can haptically check the degree by which the product is cooled or heated.

The exemplary second embodiment of the present invention is explained so far, but the present invention is not limited thereto, and various modifications are still possible.

In the second embodiment described above, at Step S210, the control unit 100*a* outputs a product removed command to the currency processing device 15 to cause the currency processing device 15 to return the change, for example. Alternatively, according to the present invention, upon receiving a detection signal from the removal detecting sensor 5 at Step S207, the control unit 100*a* may subtract the product price from the deposited amount, and record the remaining. When the remaining thus recorded is equal to or more than the product price, the control unit 100*a* may perform the process at Step S202 and the subsequent process. This alternative allows a plurality of products to be purchased successively.

In the second embodiment described above, depending on the amount deposited, the cases can be classified as follows: a case in which a product is allowed to be taken out only from the top product rack 30*a*; a case in which a product is allowed to be taken out from the product racks 30*a* and 30*b*; a case in which a product is allowed to be taken out from the product racks 30*a* to 30*c*; and a case in which a product is allowed to be taken out from the product racks 30*a* to 30*d*. The following alternative is also possible according to the present invention. As an example, the support rod may be provided with a hexadecagonal shape, and the shape of each of the switching cam members may be devised so that the configuration is classified into those in which a product is permitted to be taken out from any one of the product racks 30*a* to 30*d* (four patterns), in which a product is allowed to be taken out from any two of the product racks 30*a* to 30*d* (six patterns), in which a product is allowed to be taken out from any three of the product racks 30*a* to 30*d* (four patterns), in which a product is allowed to be taken out from all of the product racks 30*a* to 30*d*, and in which a product is prevented from being taken out from any of the product racks 30*a* to 30*d*.

Third Embodiment

Figure 31:
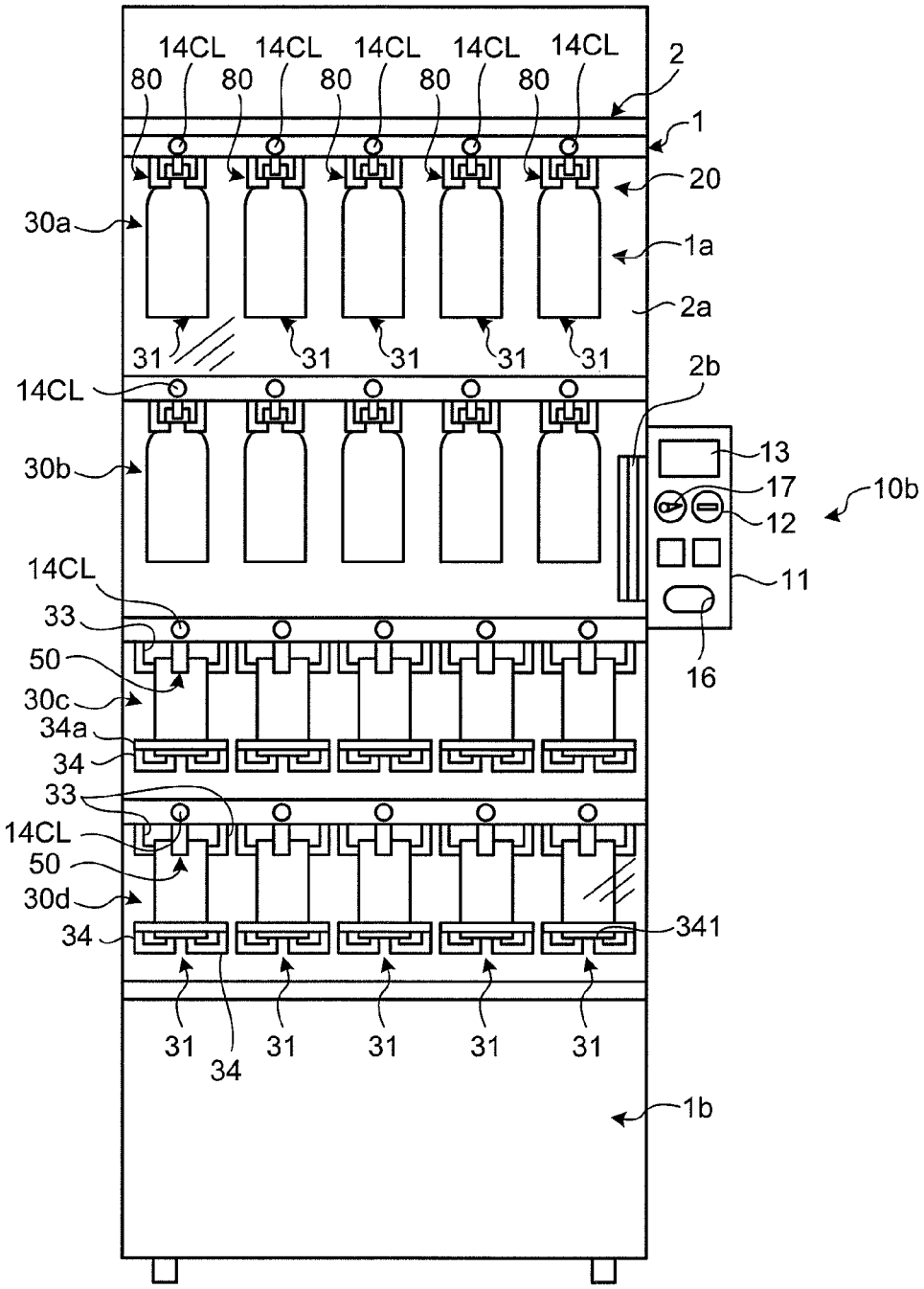
FIG. 31 is a front view illustrating an automatic vending machine according to a third embodiment of the present invention.
Figure 32:
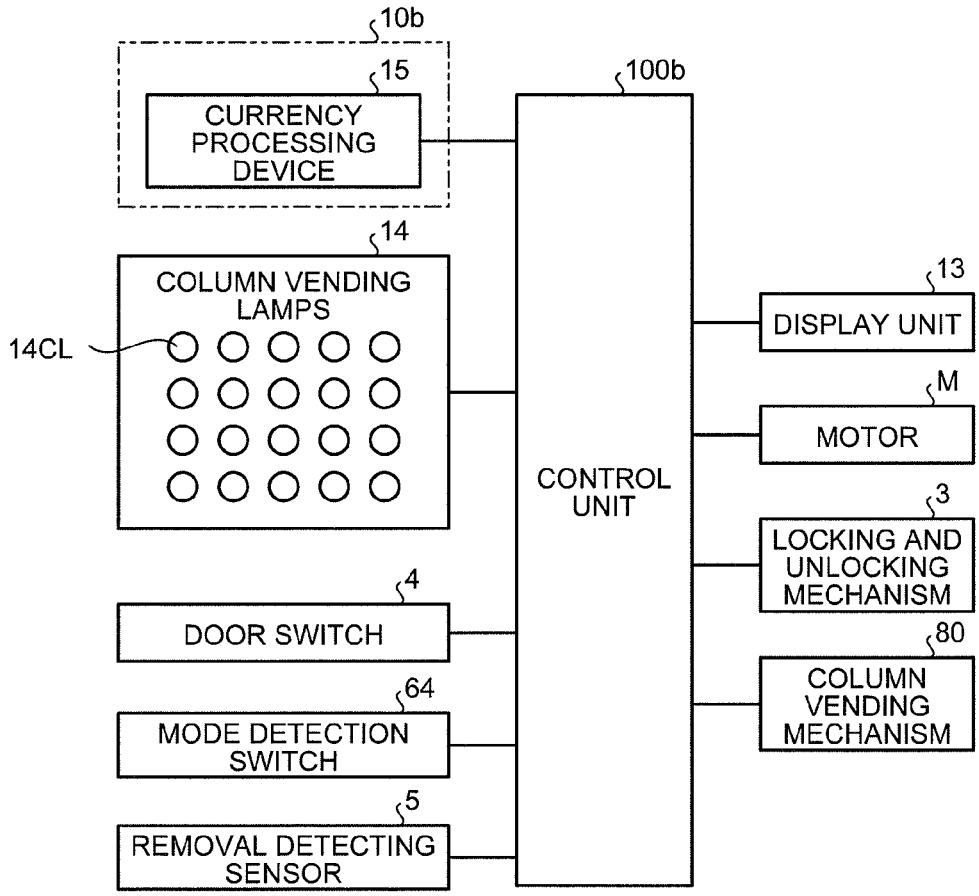
FIG. 32 is a block diagram illustrating a control system provided to the automatic vending machine according to the third embodiment of the present invention.

FIG. 31 is a front view illustrating an automatic vending machine according to a third embodiment of the present invention. FIG. 32 is a block diagram illustrating a control system provided to the automatic vending machine according to the third embodiment. Those having the same structure as those in the automatic vending machine according to the first embodiment described above are assigned with the same reference signs, and explanations thereof are omitted as appropriate.

The automatic vending machine explained herein as an example sells cooled or heated products such as canned-beverages or beverages in plastic bottles, and includes the vendor cabinet 1.

The vendor cabinet 1 is a housing having a cuboid shape, and the front side of which has an opening with an external door (door body) 2 that is opened and closed. An input processing unit 10*b* is mounted on the right side of the vendor cabinet 1. The input processing unit 10*b* includes a box-like main unit 11. The main unit 11 has a robust structure. On the front side of the main unit 11, the coin deposit slot 12, the display unit 13, and the like are provided. The currency processing device 15 is provided inside of the main unit 11.

The product storage device 20 is provided to the chamber 1*a* in the vendor cabinet 1. The product storage device 20 includes the product racks 30*a* to 30*d*, the rack selecting mechanism 60, the releasing mechanism 50, and a column vending mechanism 80.

A plurality (four in the example illustrated) of the product racks 30*a* to 30*d* are provided. In the third embodiment, the top product rack 30*a* and the second product rack 30*b* from the top store therein beverage products in plastic bottles and have the same structure, and the third product rack 30*c* from the top and the bottommost product rack 30*d* store therein canned-beverage products and have the same structure.

Each of the product racks storing therein beverage products in plastic bottles (the top product rack 30*a* and the second product rack 30*b* from the top) includes a plurality of (five in the example illustrated) product storage columns 31 arranged side by side in the horizontal direction. Each of the product storage columns 31 includes a pair of right and left rail members 32. The pair of right and left rail members 32 extend in a front-and-rear direction, and a product storage passage is defined between these rail members.

Each of the product racks storing therein canned-beverage products (the third product rack 30*c* from the top and the bottommost product rack 30*d*) includes a plurality of (five in the example illustrated) product storage columns 31 arranged side by side in the horizontal direction, in the same manner as the product racks 30*a* and 30*b* storing therein beverage products in plastic bottles.

Provided on the front side of the product racks 30*a* to 30*d* are a plurality of column vending lamps 14CL each corresponding to each of the product storage columns 31. These column vending lamps 14CL are turned ON in response to a command received from a control unit 100*b*.

The column vending mechanism 80 is provided for each of the product storage columns 31, and is caused to perform a releasing operation and a restricting operation by a solenoid not illustrated, based on a command received from the control unit 100*b*. When the column vending mechanism 80 performs the releasing operation, the column vending mechanism 80 permits the first gate member 51 in the corresponding releasing mechanism 50 to rotate upwardly. When the column vending mechanism 80 performs the restricting operation, the column vending mechanism 80 prevents the first gate member 51 in the corresponding releasing mechanism 50 from rotating upwardly. Therefore, the automatic vending machine according to the third embodiment is not provided with the restricting unit 70 included in the automatic vending machine according to the first embodiment.

In the automatic vending machine according to the third embodiment, the motor M rotates the support rod 63 included in the rack selecting mechanism 60. The support rod 63 is kept rotated until the mode detection switch 64 detects the "standby position" or the "300-degree-rotated position".

Figure 33:
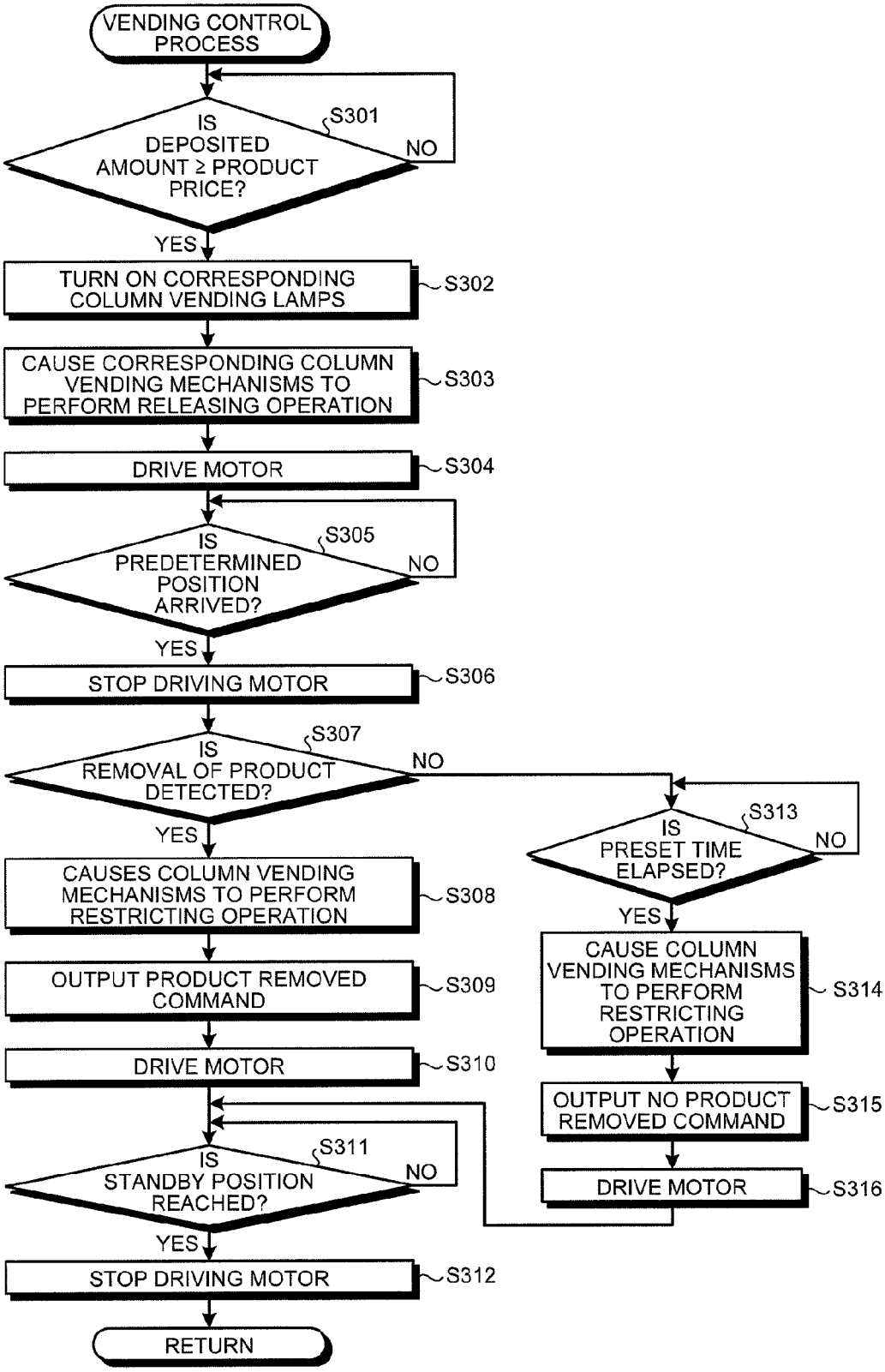
FIG. 33 is a flowchart illustrating a main part of a vending control process performed by the control unit illustrated in FIG. 32.

FIG. 33 is a flowchart illustrating a main part of a vending control process performed by the control unit 100*b* illustrated in FIG. 32. While explaining the vending control process, an operation of the automatic vending machine according to the third embodiment will be also explained.

In the vending control process, when the deposited amount (amount information) received from the currency processing device 15 is equal to or more than a product price (Yes at Step S301), the control unit 100*b* turns ON the column vending lamp 14CL corresponding to the product storage column 31 storing therein the corresponding product, and causes the column vending mechanism 80 corresponding to the product storage column 31 to perform the releasing operation (Step S302, Step S303).

The control unit 100*b* having executed Step S302 and Step S303 considers that a vending command is given, and drives the motor M (Step S304). When the mode detection switch 64 detects the "300-degree-rotated position" (Yes at Step S305), the control unit 100*b* stops driving the motor M (Step S306).

Because the support rod 63 is stopped at "300-degree-rotated position", the support rod 63 has rotated by 300 degrees from the "standby position" in the clockwise direction, and the third protrusion 653 on each of the switching cam members 65 abuts against the first slide abutting portion 612 and the second slide abutting portion 623, causing the first sliding plate 61 and the second sliding plate 62 to move to the left against the biasing force of the first spring member 61S and the second spring member 62S. In this manner, the first gate member 51 in the releasing mechanism 50 is permitted to be rotated upwardly.

When the user who opens the external door 2 takes out the foremost product stored in one of the product storage columns 31 for which the column vending lamp 14CL is turned ON, the removal detecting sensor 5 provided to the product storage column 31 detects that the foremost product has been removed, and sends a detection signal to the control unit 100*b*.

When the detection signal is received from the removal detecting sensor 5 (Yes at Step S307), the control unit 100*b* causes all of the column vending mechanisms 80 having performed the releasing operation at Step S303 to perform the restricting operation (Step S308). The control unit 100*b* then outputs the product removed command to the currency processing device 15, and outputs a product removed command to the motor M to drive the motor M (Step S309, Step S310).

The currency processing device 15 receiving the product removed command output from the control unit 100*b* returns the change, if any, into the coin return 16, and stores the currencies in the amount of the product price in a manner sorted by the currency type.

When the mode detection switch 64 detects the predetermined position which is the "standby position" (Yes at Step S311), the control unit 100*b* stops driving the motor M (Step S312), returns the process to the start, and ends the current process. In this manner, it is possible to sell one product selected by a user.

At Step S307, when a preset time elapses without receiving any detection signal from the removal detecting sensor 5 (No at Step S307 and Yes at Step S313), the control unit 100*b* causes all of the column vending mechanisms 80 having performed the releasing operation at Step S303 to perform the restricting operation, and outputs a no product removed command to the currency processing device 15 (Step S314, Step S315). The currency processing device 15 receiving the no product removed command output from the control unit 100*b* returns the deposited coin into the coin return 16.

The control unit 100*b* having output the no product removed command issues a product removed command to the motor M to drive the motor M (Step S316), performs the Step S311 and Step S312 described above, returns the process to the start, and ends the current process.

As explained above, in the automatic vending machine which is the third embodiment of the present invention, the rack selecting mechanism 60 in the standby position prohibits all of the product racks 30*a* to 30*d* from releasing any product. When a vending command is given, the rack selecting mechanism 60 permits all of the designated product racks 30*a* to 30*d* to release a product. The releasing mechanism 50 provided to each of the product storage columns 31 normally prevents a product stored in the product storage columns 31 from being taken out. When the rack selecting mechanism 60 permits the product racks 30*a* to 30*d* having the product storage column 31 to release a product, the releasing mechanism 50 operates correspondingly to the operation of taking out the product, and permits only the foremost product to be taken out. When the column vending mechanism 80 provided for each of the product storage columns 31 performs the releasing operation, the releasing mechanism 50 is allowed to operate. When the column vending mechanism 80 performs the restricting operation, the releasing mechanism 50 is prevented from operating. In this manner, a user is allowed to purchase a desired product without using a bucket driving unit in a manner practiced in a conventional automatic vending machine. Furthermore, the function of selling a product with no one attended, which is the function an automatic vending machine is originally intended for, can be provided. Furthermore, the structure can be simplified by assigning a part of a product vending operation to an operation of a user taking out a product. Therefore, the number of parts or the like can be reduced, and hence, the cost can be reduced.

Furthermore, in the automatic vending machine, because the product storage device 20 permits a user to take out one product at a time by holding the body 200*d*, the user can haptically check the degree by which the product is cooled or heated.

Furthermore, in the automatic vending machine, because the column vending mechanism 80 is caused to operate the releasing operation while the column vending lamp 14CL corresponding to the product storage column 31 storing therein products at a price equal to or less than the deposited amount is turned ON, products at different prices can be stored in the same product rack 30*a*, 30*b*, 30*c* or 30*d*, and products at various price ranges can be sold in a limited space.

The exemplary third embodiment of the present Invention is explained so far, but the present invention is not limited thereto, and various modifications are still possible.

In the third embodiment explained above, at Step S309, the control unit 100*b* outputs a product removed command to the currency processing device 15 to cause the currency processing device 15 to return the change, for example. Alternatively, according to the present invention, upon receiving a detection signal from the removal detecting sensor 5 at Step S307, the control unit 100*b* may subtract the product price from the deposited amount, and record the remaining. When the remaining thus recorded is equal to or more than the product price, the control unit 100*b* may perform the process at Step S302 and processes thereafter. This alternative allows a plurality of products to be purchased successively.

In the third embodiment, locking and unlocking of the locking and unlocking mechanism 3 in the vending control process is not mentioned. Alternatively, according to the present invention, such a process of locking and unlocking the locking and unlocking mechanism 3 may be included in the vending control process as required.

The exemplary first to third embodiments are explained above, but following configurations are still possible according to the present invention.

In the first to the third embodiments, a user is allowed to look inside of the vendor cabinet 1 through the window 2*a* on the external door 2. The present invention is not limited to a door (external door 2), and the automatic vending machine itself (vendor cabinet 1) may be provided with a window made of a transparent heat-resistant glass material, so that a window is provided on the automatic vending machine itself. In this manner, a user is allowed to look inside through the window provided on the automatic vending machine itself, without limitation to the window on the door.

In the first to the third embodiments, the products to be sold are explained to be beverages in plastic bottles or canned-beverages. Alternatively, according to the present invention, the products to be sold may be foods packed in a flexible transparent resin. In such a case, a user can haptically check the softness of the product, and understand how fresh the product is.

REFERENCE SIGNS LIST

1 vendor cabinet
1*a* chamber
2 external door (door)
2*a* window
3 locking mechanism
4 door switch
10 input processing unit
11 main unit
12 coin deposit slot
13 display unit
14 rack selection button
14RL rack vending lamp
14CL column vending lamp
15 currency processing device
20 product storage device
30*a* product rack
30*b* product rack
30*c* product rack
30*d* product rack
31 product storage column
32 rail member
33 guide member
34 setting member
40 pusher member
41 spiral spring member
50 releasing mechanism
50*a* shaft
51 first gate member
511 base end
512 tip end
512*a* protrusion
513 first engaging portion
52 second gate member
522 tip end
523 second engaging portion
53 leaf spring member
60 rack selecting mechanism
61 first sliding plate
61S first spring member
61*b*1 cutout
62 second sliding plate
62S second spring member
621 through-hole
622 lock member
63 support rod
631 coupling gear
64 mode detection switch
65 switching cam member
651 first protrusion
652 second protrusion
653 third protrusion
70 restricting unit
71 guide member
72 piece member
80 column vending mechanism
100 control unit
100*a* control unit
100*b* control unit
200*a* cap
200*b* cap fitting portion
200*c* neck
200*d* body
M motor

The invention claimed is:

1. An automatic vending machine for vending a product selected by a user, the automatic vending machine comprising:

an automatic vending machine cabinet having an opening that is opened and closed by a door;

a plurality of product racks that is provided in the automatic vending machine cabinet, each product rack including a plurality of product storage columns each storing products ordered in a line; and a product storage device that allows a user to take out one product at a time by holding a body of the product, when the door is opened to open the opening, wherein the product storage device comprises:

a rack selecting mechanism that brings the product rack to a configuration in which a product is prevented from being taken out in a standby condition, and that brings the product rack to a configuration in which a product is permitted to be taken out only from a designated one of the product racks when a vending command is given;

a releasing mechanism that is provided for each of the product storage columns, that normally prevents a product stored in the product storage column for which the releasing mechanism is provided from being taken out, and that operates correspondingly to an operation of taking out a product and allows only a product closest to the opening to be taken out when the rack selecting mechanism permits the product rack including the product storage column to release a product; and a restricting unit that is provided for each of the product racks, that permits one of the releasing mechanisms to operate and prohibits the other releasing mechanisms in the product rack from operating when the rack selecting mechanism permits the product rack for which the restricting unit is provided to release a product, the releasing mechanism comprises:

a first gate member that is provided rotatably in a manner moving forwardly and backwardly with respect to a product storage passage in the product storage column, that is normally positioned inside of the product storage passage to prevent a most downstream product positioned most downstream from being taken out, and permits the most downstream product to be taken out when the first gate member is caused to retreat from the product storage passage; and a second gate member that is provided rotatably in association with the first gate member in a manner moving forwardly and backwardly with respect to the product storage passage, that is caused to retreat from the product storage passage when the first gate member is positioned inside of the product storage passage, and that is brought into the product storage passage to prevent an upstream product positioned adjacent to the most downstream product when the first gate member is caused to retreat from the product storage passage, and the rack selecting mechanism comprises:

a first sliding member that is normally positioned at a reference position and prevents the first gate member from being caused to retreat from the product storage passage, and that frees the first gate member when the first sliding member is moved from the reference position;

a lock member that is normally kept in contact with the second gate member caused to retreat from the product storage passage by being biased by a biasing unit, and is caused to move to a position on top of the second gate member and keeps the second gate member at an orientation positioned inside of the product storage passage when the second gate member is brought into the product storage passage in association with the first gate member being caused to retreat from the product storage passage;

a second sliding member that is normally positioned at a reference position and keeps the lock member free, and that separates the lock member from the position on the top of the second gate member by moving the lock member against the biasing force of the biasing unit when the second sliding member is moved from the reference position; and a cam member that moves the first sliding member from the reference position by abutting against the first sliding member when a vending command is given, and that moves the first sliding member and the second sliding member from the respective reference positions by abutting against the first sliding member and the second sliding member when a product removed command is given.

2. The automatic vending machine according to claim 1, wherein the second gate member is connected to the first gate member with a leaf spring member interposed between the second gate member and the first gate member, and the second gate member is caused to retreat from the product storage passage against the biasing force of the leaf spring member when the first sliding member and the second sliding member are caused to move from the respective reference positions and the second gate member abuts against a product approaching from a downstream side of the product storage passage while the second gate member is positioned inside of the product storage passage.

3. The automatic vending machine according to claim 1, wherein the product storage column comprises a rail member that extends in a front-and-rear direction, and that supports a cap fitting portion to which a cap is fitted removably, the cap fitting portion being provided to a product having a neck portion between the cap fitting portion and a body, so that the rail member supports the product hanging in an upright orientation.

4. The automatic vending machine according to claim 1, wherein the product storage column comprises a setting member that extends in a front-and-rear direction and on which a product having a shape of a cylinder having a top end and a bottom end closed is placed in an upright orientation.

5. The automatic vending machine according to claim 1, wherein the restricting unit includes a guide member that extends in a direction in which the product storage columns are arranged, has a housing section in which a plurality of piece members are housed slidably in the direction in which the guide member extends, and when a part of the releasing mechanism operating correspondingly to an operation of taking out a product enters the housing section, prevents a part of another releasing mechanism from entering the housing section so that the releasing mechanism is prevented from operating.

6. The automatic vending machine according to claim 1, further comprising a pusher member that is provided for each of the product storage columns, and presses products stored in the product storage columns forwardly.

7. The automatic vending machine according to claim 1, wherein at least one of the door and the automatic vending machine cabinet comprises a window made from a transparent plate.

* * * * *